US009995087B2

(12) United States Patent
Queen

(10) Patent No.: US 9,995,087 B2
(45) Date of Patent: Jun. 12, 2018

(54) DIRECT TORQUE HELICAL DISPLACEMENT WELL AND HYDROSTATIC LIQUID PRESSURE RELIEF DEVICE

(71) Applicant: Frankie A. R. Queen, Dacula, GA (US)

(72) Inventor: Frankie A. R. Queen, Dacula, GA (US)

( * ) Notice: Subject to any disclaimer, the term of this patent is extended or adjusted under 35 U.S.C. 154(b) by 0 days. days.

(21) Appl. No.: 15/180,122

(22) Filed: Jun. 13, 2016

(65) Prior Publication Data

US 2016/0281432 A1 Sep. 29, 2016

Related U.S. Application Data

(63) Continuation-in-part of application No. 13/743,504, filed on Jan. 17, 2013, now Pat. No. 9,366,084.

(60) Provisional application No. 61/588,207, filed on Jan. 19, 2012.

(51) Int. Cl.

| | |
|---|---|
| ***E21B 10/44*** | (2006.01) |
| ***E21B 17/04*** | (2006.01) |
| ***E21B 17/22*** | (2006.01) |
| ***E21B 7/20*** | (2006.01) |
| ***E21B 7/26*** | (2006.01) |
| ***E02D 5/56*** | (2006.01) |
| ***E21B 7/00*** | (2006.01) |
| ***E21B 17/046*** | (2006.01) |

(52) U.S. Cl.

CPC ..... *E21B 10/44* (2013.01); *E02D 5/56* (2013.01); *E21B 7/005* (2013.01); *E21B 17/046* (2013.01)

(58) Field of Classification Search

CPC ..... E21B 17/22; E21B 10/44; E21B 43/04; E21B 43/10; E21B 43/08; E21B 43/082; E21B 43/088; E21B 7/005; E21B 7/26; E21B 7/20; E02D 5/385; E02D 5/801; E02D 2250/0038; E02D 5/34; E02D 5/56; E02D 7/22

See application file for complete search history.

(56) References Cited

U.S. PATENT DOCUMENTS 572,860 A * 12/1896 Brearley ..... E21B 10/44 166/229
1,080,684 A * 12/1913 Erickson ..... E21B 1/00 166/74
1,511,061 A * 10/1924 Nebergall ..... E21B 31/18 294/102.1
2,513,944 A * 7/1950 Kessler ..... E21B 17/22 166/162

(Continued)

*Primary Examiner* — Daniel P Stephenson

(74) *Attorney, Agent, or Firm* — Thomas|Horstemeyer, LLP

(57) ABSTRACT

A helical displacement well with preassembled segments includes a preassembled shaft-forming penetrator tube including helical plates mounted to its exterior that may be rotated to propel the casing into the ground. A hydraulic drill motor rotates the penetrator tube as it moves deeper into the ground. Extension tubes may be added to and coupled to the penetrator tube. A bolt including a threaded stem sized to engage the threaded bolt opening of the male connector and a cap of larger breadth than the threaded stem and sized to fit within the unthreaded tension bolt opening of the female connector for connecting the female connector about the male connector.

10 Claims, 20 Drawing Sheets

(56) References Cited

U.S. PATENT DOCUMENTS 3,178,210 A * 4/1965 Dickinson ..... E21B 17/22 175/323
3,206,936 A * 9/1965 Moor ..... E02D 5/36 285/331
3,794,127 A * 2/1974 Davis ..... E21B 17/03 175/323
3,796,448 A * 3/1974 Ringkamp ..... E21B 17/046 175/323
4,061,197 A * 12/1977 Skidmore, Jr. ..... E21B 4/14 175/101
4,363,366 A * 12/1982 Hilty ..... E21B 10/44 175/314
4,548,281 A * 10/1985 Bodine ..... E21B 43/003 166/249
RE32,076 E * 2/1986 Dziedzic ..... E02D 5/801 175/400
4,604,818 A * 8/1986 Inoue ..... E21B 7/003 175/265
4,681,163 A * 7/1987 Guidry ..... E21B 17/22 166/227
4,821,818 A * 4/1989 Mefferd ..... E21B 17/046 175/323
5,036,920 A * 8/1991 Cornette ..... E21B 17/22 166/205
5,170,850 A * 12/1992 Sassak, II ..... E02D 5/801 173/18
5,269,572 A * 12/1993 Mefferd ..... E21B 17/046 285/330
5,348,092 A * 9/1994 Cornette ..... E21B 17/22 166/114
5,394,938 A * 3/1995 Cornette ..... E21B 17/22 166/205
5,782,310 A * 7/1998 Lange ..... E21B 17/22 175/323
5,875,860 A * 3/1999 Coelus ..... E02D 5/36 175/323
6,033,152 A * 3/2000 Blum ..... E02D 5/36 175/325.3
6,298,611 B1 * 10/2001 Oliver ..... E02D 5/801 248/156
6,877,561 B2 * 4/2005 Richard ..... E21B 17/22 166/278
7,708,072 B1 * 5/2010 Hunziker ..... E21B 7/005 166/301
7,946,355 B1 * 5/2011 Kluge ..... A01K 97/01 175/18
8,322,458 B2 * 12/2012 Stoetzer ..... E02D 5/34 173/145
8,511,941 B2 * 8/2013 Curic ..... E02D 5/36 175/19
9,127,513 B2 * 9/2015 Matthias ..... E21B 17/046
9,366,084 B2 * 6/2016 Queen ..... E21B 7/005
2002/0031405 A1 * 3/2002 Queen ..... E02D 5/30 405/249
2002/0081159 A1 * 6/2002 Xu ..... E21D 9/10 405/259.1
2003/0089525 A1 * 5/2003 Sherwood ..... E02D 5/36 175/57
2004/0105728 A1 * 6/2004 Schmidmaier ..... E21B 17/22 405/240
2005/0232700 A1 * 10/2005 Timmerman ..... E02D 5/765 405/31
2007/0023207 A1 * 2/2007 Perpezat ..... E02D 5/385 175/394
2009/0084549 A1 * 4/2009 O'Malley ..... E21B 43/04 166/278
2010/0143048 A1 * 6/2010 Lin ..... E02D 5/523 405/244
2011/0150578 A1 * 6/2011 Deichmann ..... B05B 15/062 405/224
2011/0220348 A1 * 9/2011 Jin ..... E21B 17/042 166/244.1
2012/0087740 A1 * 4/2012 Stroyer ..... E02D 5/36 405/241
2014/0154013 A1 * 6/2014 Mehr ..... B09B 1/008 405/129.55
2014/0196955 A1 * 7/2014 Queen ..... E21B 7/005 175/57
2015/0368870 A1 * 12/2015 Lutenegger ..... E02D 5/56 405/252.1
2016/0281432 A1 * 9/2016 Queen ..... E21B 10/44

* cited by examiner

Helical Displacement Well

DIRECT TORQUE HELICAL DISPLACEMENT WELL AND HYDROSTATIC LIQUID PRESSURE RELIEF DEVICE

CROSS REFERENCE TO RELATED APPLICATION

This is a continuation-in part of U.S. patent application Ser. No. 13/743,504, filed in the U.S.P.T.O. on Jan. 17, 2013. Applicant claims the benefit of U.S. provisional patent application Ser. No. 61/588,207, filed Jan. 19, 2012.

FIELD OF THE INVENTION

This invention generally concerns an improved method and apparatus for installing an earthen well for retrieving and channeling water and other liquids or fluids. This method and apparatus may be used in the relief of hydrostatic earthen water pressure, and includes an improved coupling for expedient end-to-end connection of an helical pipe that first penetrates the ground and the following extension pipe that extends upwardly or horizontally to reach the surface of the ground to form a well, drain, pile or stabilizing device.

BACKGROUND OF THE INVENTION

When digging a typical well, well drillers usually use a tool that utilizes augured flighting, so that when the tool is moved into engagement with the surface of the earth and rotated, the auger moves the tool into the earth as it removes and lifts the surrounding material upwardly to the surface of the earth. This soil laterally displaced by the insertion of the helical pipe forms an open and cased well shaft in the earth. When the well shaft is completed, the augured tool is removed from the well shaft and well casing and internal components can be built into the excavated shaft formed by the augured tool.

Once the well bore is inserted, the helical pipe may be rotated in the opposite direction to remove the helical pipe from the well opening and leave the well open for the insertion of an internal plastic or metal well casing, well screens, a gravel filter, gravel filter pack or pump and associated equipment. The gravel pack prevents sand and fine particles from moving from the aquifer formation into the well. Usually, the helical pipe is manufactured of durable material so it can be retracted and used again to implement at other sites.

At the surface of the well, a surface casing is commonly installed to facilitate the installation of the well seal. The surface casing and well seal protect the well against contamination of the gravel pack and keep shallow materials from caving into the well.

It is problematic that the excavated well shaft will collapse if the surrounding soil is not stable. When the well shaft is to be excavated at an angle other than vertical, there is even a greater risk of well collapse due to gravity. To avoid a well collapse, well drillers often use drilling fluids such as bentonite to help maintain the shape and integrity of the shaft. Also, the excavated well usually develops debris during the digging activities that tends to fall into the excavated shaft that may form an obstruction to placement of the well casing into the well excavated shaft. Well drillers usually must remove the debris from the excavated shaft before the well casing is placed in its final position within the shaft. To remove the debris well drillers typically use fluids that circulate in the excavated well shaft. Use of these materials and the associated labor increase the costs of the well installation, and in some situations may cause the well drillers to move the site of the well.

SUMMARY OF THE INVENTION

This disclosure concerns a direct torque segmented helical displacement well formed in preassembled sections that are moved to the well site for their assembly. The helical displacement well includes a penetrator tube that functions as a leading drill conduit as it is being installed in the ground, and includes extension tubes that are mounted coaxially on the penetrator tube at the well site.

The penetrator tube includes external helical plates that draw the conduit segments of the well into the ground in response to rotating the well conduit segments, generally without displacing the earth upwardly but compacting the earth laterally about the penetrator tube. The helical plates remain affixed on the penetrator tube and function to thrust and stabilize the penetrator tube and extension tubes in the ground. The assembly may include a closed penetrating end cap that covers the bottom opening of the penetrator tube and is shaped to assist in penetrating the earth and retarding the movement of earth into the well segments.

The penetrator tube is configured for passing ground water from different types of wells, including Artesian wells, upwardly toward ground surface. The helical plates remain affixed to the penetrator tube in the bore hole of the well for the life of the well.

This is a disclosure of a helical displacement well that utilizes prefabricated tubular segments to form the well structure with the lowermost well segment having externally protruding helical plates that extend into the earth that remain in the earth and support the assembled well in the earth. The upper end of the cylindrical penetrator tube is fitted to receive a coupling capable of resisting torque necessary to turn the penetrator tube into the ground, to accommodate an open annulus and provide a positive means of fixed retraction of the well structure from the ground.

A coupling is positioned between and connects the extension tube in alignment with the penetrator tube. The coupling includes a male connector and a female connector shaped to fit together. The male connector includes a cylindrical collar defining an opening extending there through sized and shaped to receive an end of one of the penetrator tube or the extension tube, and a plug of smaller breadth than the collar extending axially away from the collar. The plug includes a plug internal passage extending axially there through, and the plug internal passage has a breadth sized and shaped to extend coextensively with the internal passage of the penetrator tube or the extension tube and includes at least one external alignment rib extending longitudinally there along. The female connector includes at one end an internal collar sized and shaped to fit against the plug of the male connector, and a cylindrical internal surface with locking strips sized and shaped to mate with the external alignment rib of the male connector.

The helical well system of this disclosure can be installed in just minutes as compared to hours with conventional means. Readily available construction equipment typically used for installing helical piles is all that is needed to install the helical displacement well disclosed herein into the earth.

The penetrator tube of the helical displacement well of this disclosure assembly acts as a direct torque penetrator tube that functions as a lead conduit that remains in situ with the earth and forms the leading end of the well casing that supports other components of the well. The helical displacement well penetrator tube includes a cylindrical casing with laterally extending helical plates mounted to the exterior of the casing that are angled so that when the casing is rotated the helical plates move the well casing into the ground, creating thrust for the installation of subsequent well casing. Subsequent tubes known as extension tubes are affixed to the penetrator tube and to each other to complete the in situ well casings in place as they are turned into the earth.

The helical plates and the well casing that supports the helical plates tend to radially compact the adjacent earth that is being displaced during the penetration process, instead of moving the displaced earth axially to the surface of the ground as done by the typical augured shaft installations. The compaction of the earth adjacent the well casing provides additional support and stability of the helical displacement well.

When the helical plates of the penetrator tube reach the desired depth in the ground they extend laterally into the adjacent soil and become anchors for the well structure. This is in contrast to the function of an auger that usually has a continuous blade that wraps continuously about the shaft and moves the adjacent soil to the surface of the excavated well and that must be removed and disposed of.

The internal components of an auger excavated well are placed into the confines of the penetrator tube and extension tubes of the excavated well after it has been excavated. By contrast, the segments of the helical displacement well, including the penetrator tube and extension tubes, may have their internal components placed inside their casings prior to moving these well segments into the ground.

Once the prior art excavated wells have been constructed, even those utilizing drilling fluids, the subsequent purging and flushing development of the well is accomplished by utilizing air and/or water in order to create a clean flow. By contrast, when the helical displacement well as disclosed herein is used, drilling fluids may be eliminated and the well development phase is either eliminated or substantially reduced.

In the helical displacement well the penetrator tube becomes part of the well casing and functions similar to a helical pile of the types used as foundation support elements. The helical plates about the well casing creates thrust through the soils, pulling the shaft of the helical casing into and through the soil until the helical plates enter resistant soils. The helical plates eventually may be bored into a rigid soil matrix at which time the resistance due to the stiffness of the soils allows the helical plates to support the load of the well casing in either compression or tension. The designed load in either compression or tension is supported as the helical plates rest within the more rigid soil matrix and is transferred through the shaft of the helical well casing through and into the soils dense enough and strong enough to support the specified load and length.

Installation of the helical displacement well can be accomplished from an external or internal means in much the same manner as helical piles are currently installed. Hydraulic drill motors are used to torque the helical displacement well into the ground. Torque indicators usually are used to monitor the torque during installation in order to provide sufficient data to verify that the helical displacement well is properly installed since there is a direct correlation to load capacity and torque.

A natural subterranean Artesian well may be created due to hydrostatic pressure. In the typical Artesian well, the water is trapped beneath impervious or semi-impervious layers of soil or rock and placed under pressure by a higher elevated aquifer. Artesian wells usually include an open ended pipe casing drilled into the earth and into or through these impervious or semi-impervious soil and rock layers. The pipe creates a relief artery for the water to escape. The helical displacement well of this invention that is hydraulically driven into the soil creates an excellent means of providing a controlled Artesian well, especially in shallow applications.

Another application of this invention is the relief of deep hydrostatic groundwater pressure behind earthen retaining walls. There are times when civil design engineers must overdesign these structures when there is a reason to believe that the existing hydrostatic groundwater pressure deep behind the retaining wall creates an unknown and undetermined problem. The helical pipe casings may be drilled on an angle or horizontally behind the wall to provide a relief conduit for the pressure imposed upon the wall to relieve itself. The relief can happen in the form of direct pressure from the hydrostatic head itself or from the gravity of the groundwater.

Yet another application for this invention is as earthquake relief pile supporting a structure. As liquefaction happens with the earth during a seismic event the internal cavity of the helical conduit will allow for the ground pressure to find a path of release. This path of release can also be referenced as the path of least resistance. By creating a release mechanism, the potential damage to the structure can be mitigated or minimized The installation of this direct torque helical displacement well that relieves the pressure in the instances described above results in additional benefit for the owner, contractor and engineer when the system is installed as described herein. Since the well displaces the soil as it is penetrating the earth, the soil is compacted adjacent and along the longitudinal axis of the pipe conduit which improves the soil strength along and around its axis. The helical displacement well results in a two-fold benefit of removing the hydrostatic groundwater pressure effect on the wall and making it a stronger section where it has been installed.

Sometimes existing walls such as retaining walls have been constructed utilizing underground drainage systems in their construction. There are times when problems result from poor workmanship in the construction of the drainage systems behind these walls. There may be times where the hydrostatic ground water pressures are not taken into consideration or they may be unknown at the time the wall was designed. The hydrostatic groundwater pressure relief aspect of this invention allows its pipe conduit to be installed after the wall has been constructed, allowing for a method of correction after a problem has occurred and has been identified.

Yet another application much like the horizontal drain behind retaining walls referenced, is the use of the helical conduit as a horizontal drain and slope stabilization device. The horizontal drain will act to relief the water retained within the soils in the slope reducing the surcharge weight associated with a potential slope failure while at the same time act as a pin inserted within the slope to help stabilize the slope across and into soil bearing soil located behind the failure plane.

Another such application of the direct torque helical displacement well may be the relief of hydrostatic groundwater pressure from the seepage in, around and underneath a levee. Levees, sometimes referred to as dikes, usually are permanent earthen embankments built adjacent rivers or waterways in order to confine the flow of a river which might result in higher and faster water flow. They are also used to prevent flooding of adjacent lowland countryside and to slow natural course changes in a waterway in order to provide reliable shipping lanes for maritime commerce.

In the past, potential levee breeches caused by seepage have been repaired or reinforced with sandbags used to increase and maintain the water seepage caused by hydrostatic groundwater pressure by increasing the height of the water flow in an attempt to equalize the pressure. Often times in the past, relief water wells have been installed in order to help remediate the seepage and to reduce or redirect the hydrostatic head flow.

In utilizing the direct torque helical displacement well and hydrostatic relief system device and methodology of this disclosure, relief wells can be installed in and around sand boils which are telling signs of hydrostatic groundwater pressure in and around levees. The helical displacement wells are used to equalize, reduce or redirect the water flow without the pitfalls of current well construction and excavation techniques and the difficulties caused by constantly churning and flowing ground water. The utilization of this apparatus and methodology provides a quick, economical and sound way of fighting potential floods until the proper corrections can be made to repair the damaged levees.

Time savings and equipment savings result in money saving advantages in this type of well installation. An additional advantage is that there are virtually no soils removed during the installation process which saves the time and effort of having to deal with those materials which may sometimes be contaminated.

Another advantage is that the helical displacement well itself can be retracted, cleaned and reused at another location. Yet another advantage is that the wells can be installed in limited access, low overhead areas as well, and in remote locations where it would be cost prohibitive to move specialized well drilling equipment to a site, and would allow a more economical means of installing a well by utilizing readily available equipment to do so.

The helical well technique as disclosed herein could be categorized as an entirely new method which may not even require the same permitting as currently required for well installation. The fact that the well can be installed in tight quarters, remote locations utilizing standard readily available construction equipment would make it valuable in many instances.

Some advantages of the helical displacement well of this invention include functioning of the well with virtually no soil excavated from the well hole, resulting in little or no required removal of displaced soil. There are no soils removed or spoils to dispose of:

- The well may be retractable from the ground since the helical casing can be rotated in the reverse direction in which it was installed, and may be reused
- The structure of the well is segmental in installation
- No specialized equipment is required and the well utilizes smaller readily available construction equipment
- The well is less expensive to install than with currently available well technology installations
- The well provides "instant" well access
- The well can be produced with commonly available materials capable of withstanding the torques required for installation.
- The well substantially eliminates the need for expensive drilling mud and its costly maintenance and disposal, and minimizes the amount of flushing required due to the elimination of residual drilling mud or other drilling fluids during well development.
- The well allows for the end of the well to be sealed or capped in place as part of the drilled casing installation.
- The well provides a means of inserting a prepackaged gravel pack around the well screen and inserted into the helical pipe casing.
- The well can provide a larger diameter well as a "direct torque" means of installation over current "direct push" technologies which are limited by a reaction weight only.
- The well results in lower mobilization costs to and from the well site.
- The well minimizes the need for consumables, such as bentonite, sand and grout in most applications.

A special coupling may be used to mount the extension tube on the penetration tube which eliminates the need for bolts to be placed through the conduit sections to resist the applied torque and keep the conduits linked together. This keeps the internal annulus of the pipe open at the coupling points, providing the necessary space to receive a well screen, pump and other interior apparatus, material, medium or equipment, to allow moving a liquid from one position to another. This technique will also allow a liquid to flow freely through the conduit shaft of the unit and gravity feed as a drainage vessel without obstruction through the shaft.

Holes fabricated into the appropriate sections of the well casing will allow water or any other liquid to infiltrate and migrate to the interior regions of the conduit and pool at the ground water level. An exception might be from an Artesian well whereas the water is hydraulically forced into, through and out of the conduit by earth pressure, to a level higher than the ground level.

Since there are variable requirements of installation for the conduits, the conduits will be capable of installation at different angles from vertical, from the horizontal to the vertical, depending upon the application. The segments of the conduit may be fitted with a sectional, multiple or single length well screen sleeves or other types of filter media in order to assist in filtering the water as it enters the conduit.

The segmented well disclosed herein also may be used in combination as a pile, and as a means of providing drainage for various soil conditions and applications and also to provide water wells capable of being utilized to remove and/or treat or monitor in situ water levels. The helical displacement conduit can also serve as a structural element providing a potential dual purpose.

Another advantage of this well installation method includes the capability of retraction from the ground at any time during installation or after the well is of no further use.

Yet another advantage of this method of installation would be that upon extraction, the well can be cleaned and reutilized which would offer significant potential savings to the end user. The helical displacement well would be an excellent means of water monitoring in environmentally sensitive soils, or providing shallow access to water in remote locations economically.

Other objects, features and advantages of this invention will become apparent upon reading the following specification when taken in conjunction with the accompanying drawing.

BRIEF DESCRIPTION OF THE DRAWINGS

FIGS. 31A, 31B, 32C and 31D are illustrations of the front, right and back sides, respectively, of the female component of the coupling, with FIG. 31D showing a cross section of the female component of the configuration of FIG. 31A.

DETAILED DESCRIPTION

Figure 1:
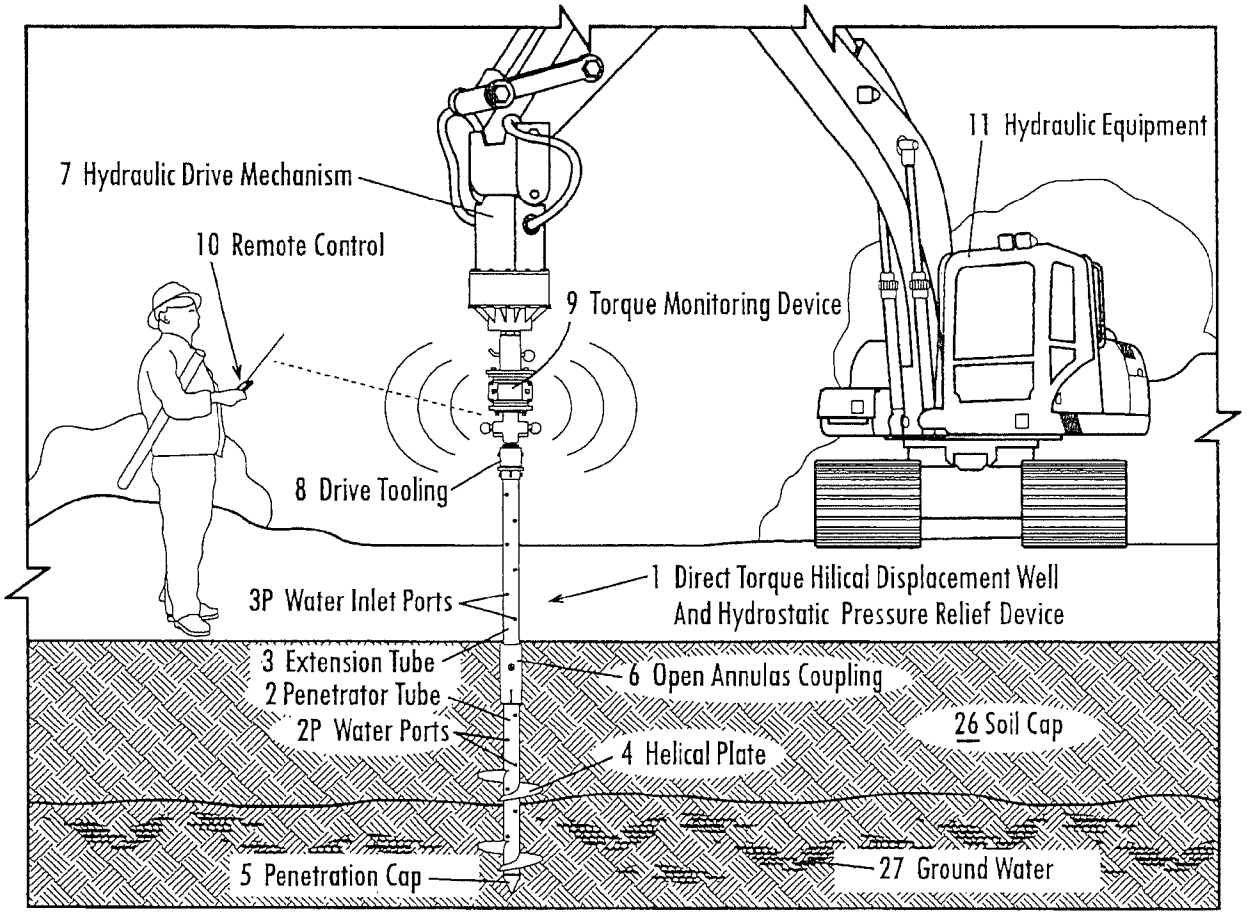
FIG. 1 is a schematic view of the Direct Torque Helical Displacement Well showing the hydraulic equipment utilized to rotate the well assembly as it penetrates the earth.
Figure 2:
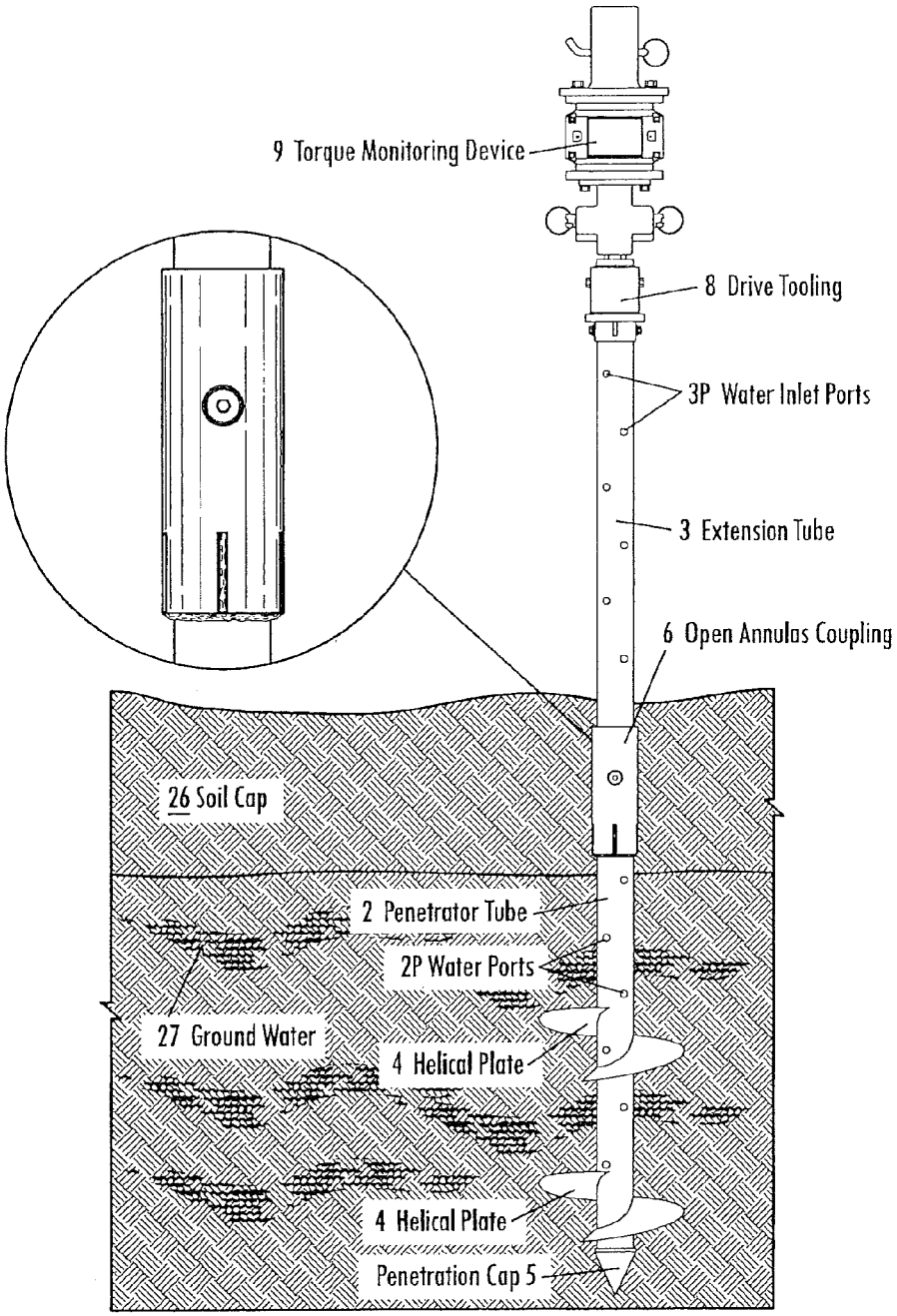
FIG. 2 is a side elevational view of the helical displacement well, showing its lower portion with the helical plates buried in the ground, and a detail of an open annulus coupling that connects the well segments together.

Referring now in more detail to the drawings, with like numbers referring to the same parts in the several views, FIGS. 1 and 2 illustrate embodiments of the assembled direct torque helical displacement well 1 which may be used as a well or as a hydrostatic pressure relief conduit. FIG. 1 shows how the well is being installed in the ground by an applied direct torque force exerted upon it by a hydraulic drive mechanism 7 to a penetrator tube 2 which is a rectilinear cylindrical tube and is rotated by the hydraulics from the hydraulic installation equipment 11. The hydraulic drive mechanism is considered to be prior art and is available from Eskridge and is identified as an anchor drive.

The helical displacement well 1 may include a leading external steel conduit penetrator tube 2 that makes the initial penetration in the soil and usually at least one external steel conduit extension tube mounted to the upper end of the leading penetrator tube 2. Helical plates 4 are mounted to the external surface of the penetrator tube and extend outwardly from the penetrator tube. The helical plates are tilted with respect to the longitudinal central axis of the penetrator tube so as to act in an auguring manner when the penetrator tube is rotated. This forces the penetrator tube axially through the surrounding earth.

The hydraulic drive mechanism 7 is connected to a torque monitoring device 9. The torque monitoring device is prior art and is fitted with digital readout gauges on the unit or a remote control device 10 to the upper end of the penetrator tube that allows the field personnel to monitor the amount of torque that is being applied to the helical displacement well 1. This monitors the applied force in order to make field decisions as to the proper depth and soil resistance required to insure that the installation is completed in the correct manner.

The drive tooling 8 of FIG. 1 includes the transition attachment from the torque monitoring device 9 to the helical displacement well and hydrostatic pressure relief device 1, allowing the torqueing force from the hydraulic drive mechanism 7 to be uniformly applied as the helical displacement well is being inserted into the earth.

As shown in FIGS. 1 and 2, the helical plates 4 are affixed to the lower penetrating end section of the penetrator tube and the bottom opening of the penetrator tube is closed by the attachment of a penetrator cap 5, also known as a pilot drive point, that also eliminates the likelihood of soil entering the penetrator tube. The helical plates create longitudinal thrust as the plates are torqued into the earth, pulling the external steel penetrator tube 2 into and through the earthen soil cap 26 and penetrating the ground water table 27.

The open annulus coupling 6 connects adjacent ends of the penetrator tube 2 and extension tube 3, and additional extension tubes may be connected in like manner until the proper depth or torque limitation has been reached. The water ports 3P may be drilled into the lower extremities of the external steel extension tubes 3 which allow for the penetration of the ground water 27 into the open annulus of the assembled conduits as the system reaches the ground water table beneath the surface of the earth.

FIG. 2 is a closer elevation and perspective view of the helical displacement well or hydrostatic pressure relief vessel, the open annulus coupling and the installation tool train. Shown in a more detailed perspective is the helical displacement well or hydrostatic pressure relief conduit. Drive tooling 8 and a direct torque monitoring device 9 are fitted between the hydraulic drive equipment and the top of the penetrator tube or the top of an extension tube. The drive tooling 8 is temporarily affixed to the conduit in order to hydraulically turn the penetrator tube 2 and helical plates 4 into the ground.

The penetrator cap 5 affixed to the insertion end of the external steel conduit 2 guides the assembly as it is driven into the earth.

The helical plates that are affixed to the lower section of the penetrator tube create axial thrust to the assembled penetrator and extension tubes, thus pulling the assembled segments of the helical displacement well into the soil. The helical plates 4 are sized according to the anticipated strength of the soils being penetrated in order to provide maximum thrust and to maximize the depth as to which steel conduits 2 are pulled into the earth for each rotation of the helical plates.

As shown in FIG. 1, the penetrator tube 2 penetrates the soil cap 26 and the soil containing the ground water 27 and the ground water 27 enters the water inlet ports 2P of the penetrator tube 2 and is extracted or monitored through the steel conduit 2 and extension tube 3 and the open annulus coupling 6 from ground level above. Additional steel extension conduit sections 3 may be added at certain intervals of downward movement of the assembled section of the helical well in order to obtain additional depth of the well. Optionally, the extension tubes may be fitted with water inlet ports 3P.

Figure 3:
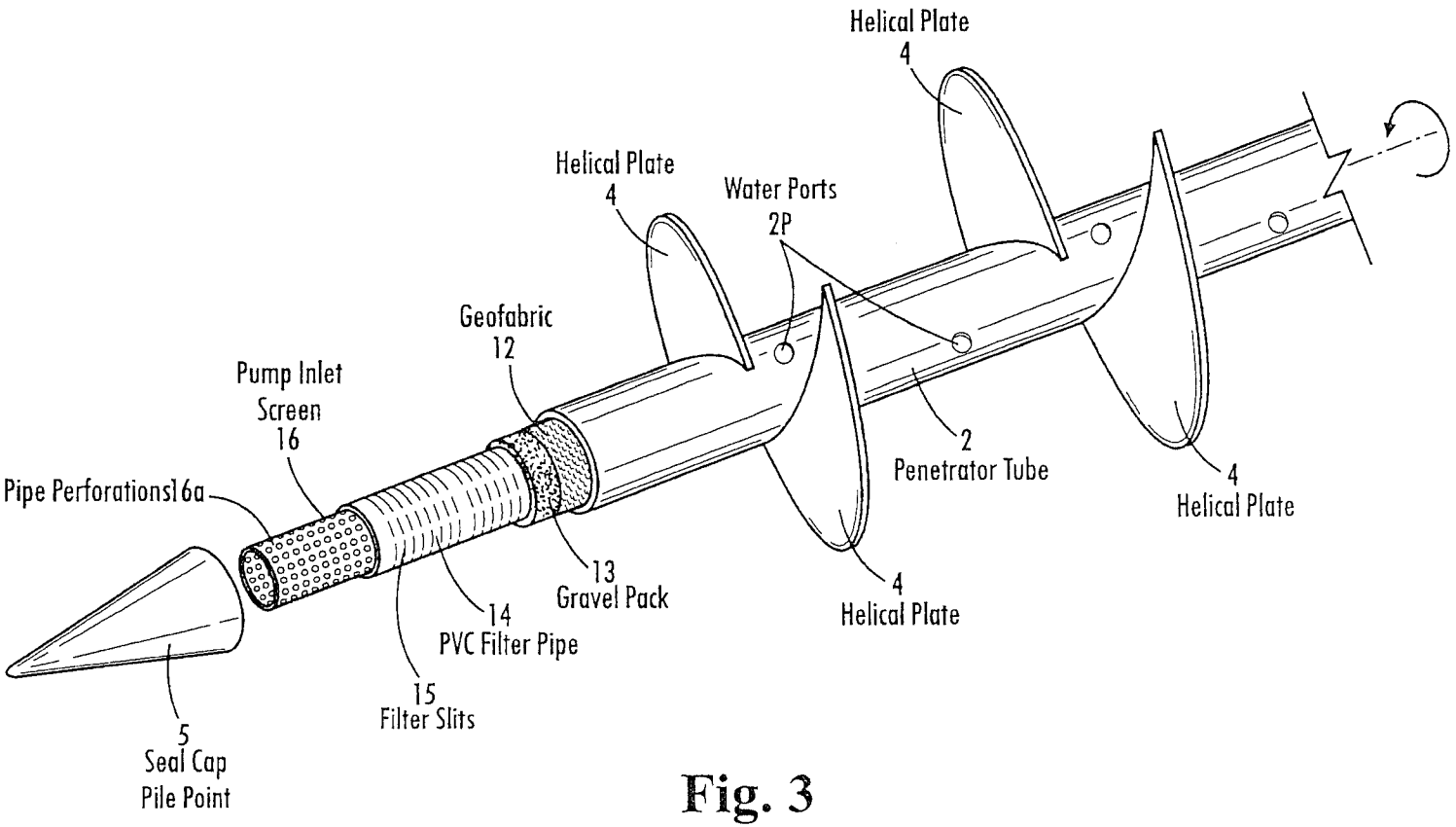
FIG. 3 is a perspective view of the lower portion of the helical displacement well, showing the helical plates and a cut-away of the external tube to expose the geofabric, gravel pack, filter pipe and pump inlet screen.

FIG. 3 illustrates an expanded perspective view of the helical displacement well or, depending on its use, the hydrostatic pressure relief conduit, showing the external steel conduit "casing" that represents the "lead section" or initial length of steel conduit known as the penetrator tube 2 that penetrates and enters the earth. The penetrator tube is fitted with the penetrator cap 5 that functions as a pile point, shown apart for clarity purposes, which creates a seal of the lower end of the assembled penetrator tube and extension tubes. This causes the water of the well bore to enter the well casings via the water inlet ports 3P and into the annulus of the steel penetrator tube 2, and provides a leading point to penetrate and guide the steel conduits 2 into the earth.

As shown in FIG. 3, the penetrator tube and extension tubes are prefabricated with filter inserts that filter the liquid entering through the inlet ports 2P. These filter inserts may include concentric tubular shapes of geofabric 12, gravel pack 13, PVC filter pipe 14 that includes filter slits 15, and pump inlet screen 16. The water entering through water inlet ports 2P engage and pass through the inserts. The perforated pump inlet screen 16 may be manufactured from stainless steel in order to reduce corrosion when the well is used for drinking water.

When additional filtration is required at the lower extremities of the well, a prepackaged gravel pack 13 encapsulated within a geofabric 12 may be inserted telescopically and utilized to further the filtration process.

The pump inlet screen 16 of FIG. 3 may be telescopically received within the PVC filter pipe 14. The pump inlet screen 16 is cylindrical and may be inserted into the penetrator tube 2 of the well structure by itself, without the filter pipe, and may be made of stainless steel when the well is producing drinking water.

Figure 4A:
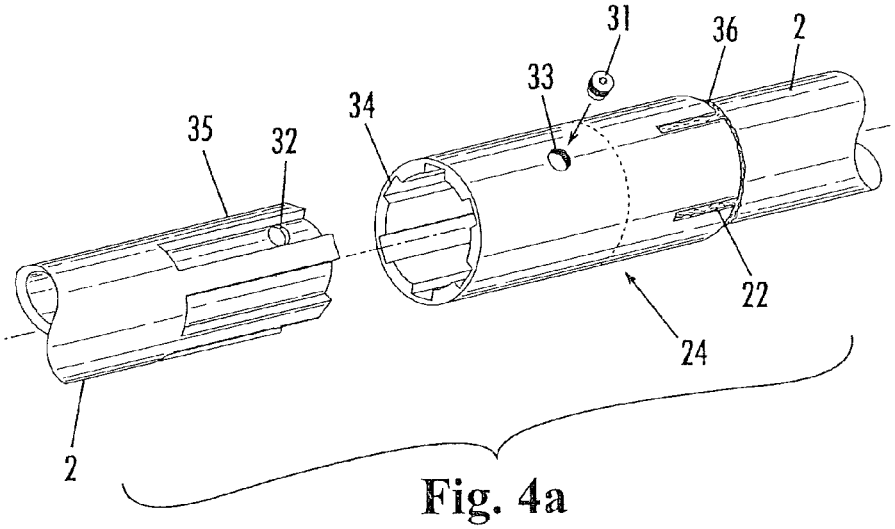
FIGS. 4*a*, 4*b* and 4*c* are illustrations of a non-rotatable coupling that connects the segments of the external conduit together so that the segments rotate in unison.
Figure 4B:
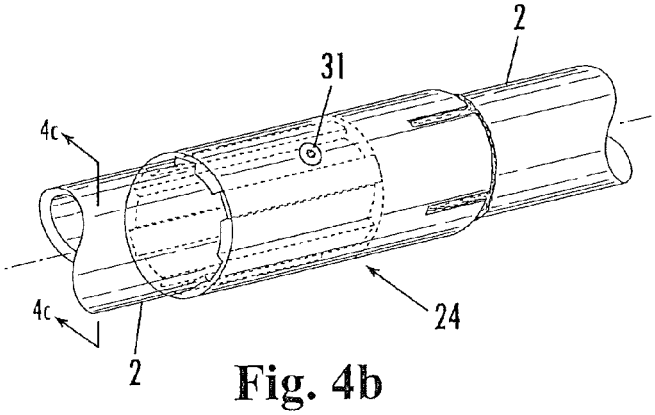
Figure 4C:
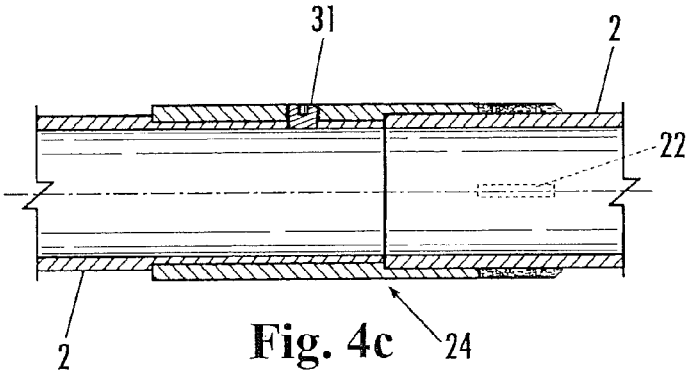

The segments of the helical displacement well 1 are connected together by a non-rotatable coupling so that the penetrator tube 2 and the extension tubes 3 always rotate in unison. For example, FIGS. 4*a*, 4*b* and 4*c* illustrate an open annulus spine coupling 24 that joins the adjacent ends of the penetrator tube and the extension tube, and for connecting the adjacent ends of additional extension tubes. The couplings define a central opening or "annulus" that allows for passage of liquid and objects such as water filters. The parts of the connector are shown separated in FIG. 4*a*, coupled together in FIG. 4*b*, and in cross-sectional view taken along the length of the coupled section in FIG. 4*c*. The female coupling body 24 of the coupling is fabricated with internally facing splines 34, and the adjacent ends of both tubes have complementary externally facing splines 35 that fit between the female splines 34. Typically, the female coupling body will be mounted on the upper ends of both the penetrator tube and extension tubes prior to reaching the well site. When a tube is to be added to a previously installed tube, the tube to be added will have its open end connected to the coupling that was previously mounted on the prior tube.

The spline coupling 24 may have internal protrusions as shown in FIG. 4*c* that stop the movement of the ends of the tubes into the coupling so that the ends of the tubes abut each other and avoid forming an obstruction to the movements of the filter inserts and liquid passing through the aligned tubes and maintain the inserts aligned from one tube to its adjacent tube.

This spline design maintains the adjacent ones of the assembled tubes to be non-rotatably connected to one another and allows for multiplied torque resistance during installation.

As shown in FIGS. 4*a*, 4*b*, and 4*c*, the steel pipe conduit of the penetrator tube 2 is inserted within the female coupling and may be welded at 36 to make a positive connection. At the same time, buttress welds 22 are made parallel to the longitudinal axis in order to increase the torque resistance necessary for installation.

As shown in FIG. 4*b*, upon insertion of the male protrusion into the female receiver's matching splines, the coupling is made complete and the interior pipe diameters abut each within the coupling, allowing for a continuous open annulus of the steel conduit. A threaded recess tension bolt hole 33 is formed in the female coupling and becomes aligned with a matching smooth recessed tension bolt hole 32 formed in the male protrusion section of the coupling. A recessed tension bolt 31 is then inserted into the threaded tension bolt hole 33 with the end of the recessed tension bolt 31 protruding into the recessed tension bolt hole 33 no farther than the interior surface of the open annulus pipe coupling 24. Said recessed tension bolt 31 serves as a safety device for tension capacity in excess of what the coupling itself can afford during extraction of the steel conduit sections 2. The recessed tension bolts also eliminate additional drag during the installation due to its unexposed bolt head not dragging through the soil as the steel conduits 2 penetrate the earth.

Figure 5A:
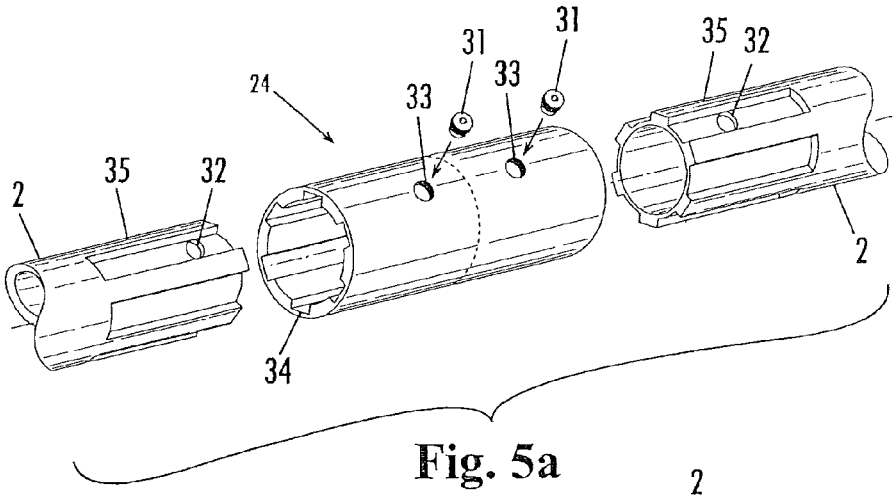
FIGS. 5*a*, 5*b* and 5*c* are similar to FIGS. 4*a*, 4*b*, and 4*c*, but show a modified coupling.
Figure 5B:
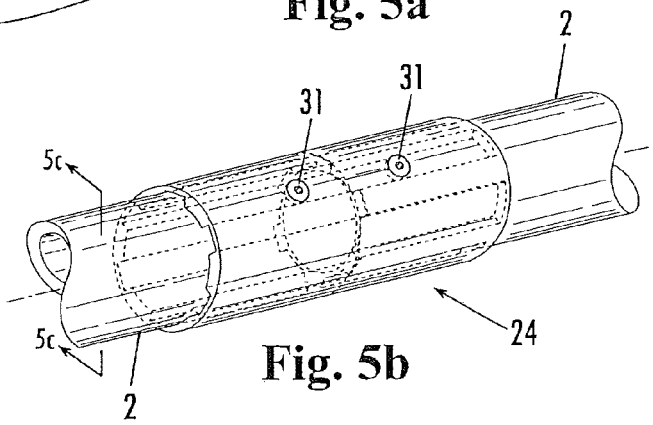
Figure 5C:
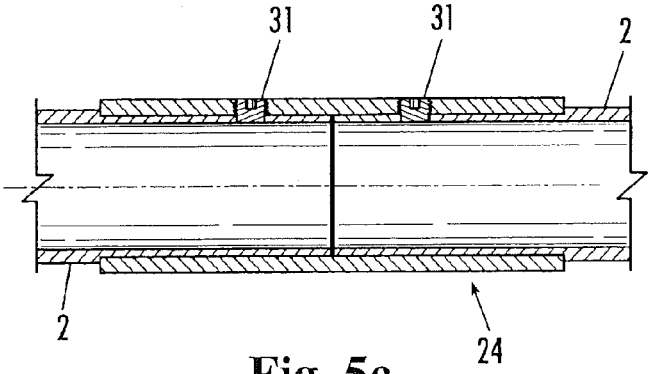

FIGS. 5*a*, 5*b* and 5*c* are another example of how the open annulus spline coupling 24 may be made. The female coupling body 24 is fitted interiorly with splines and spline receivers 34 along its full length. Positioned along the female coupling body which is open on both ends, are two (2) threaded recessed tension bolt holes 33 for receiving recessed tension bolts 31. Recessed tension bolts 31 reduce the drag caused during installation of an exposed bolt head as the steel conduits penetrate the soil. In this application, there are two male protrusion ends fitted into the steel pipe conduit 2 that have matching splines 35 and intermediate spline receivers. Each of the male protrusion ends are equipped with a recessed tension bolt hole 32 that mirror the threaded tension bolt holes of the coupling body which receive the full length of the recessed tension bolts but no further than the interior surfaces of the steel pipe conduit sections 2.

FIG. 5*b* shows this coupling technique in its coupled state and the recessed tension bolts 31 inserted and flush with the exterior surfaces of the coupling body.

FIG. 5*c* is a cross-sectional view of the open annulus spline coupling taken along its longitudinal axis and across the recessed tension bolts 31 in a coupled configuration.

Figure 6A:
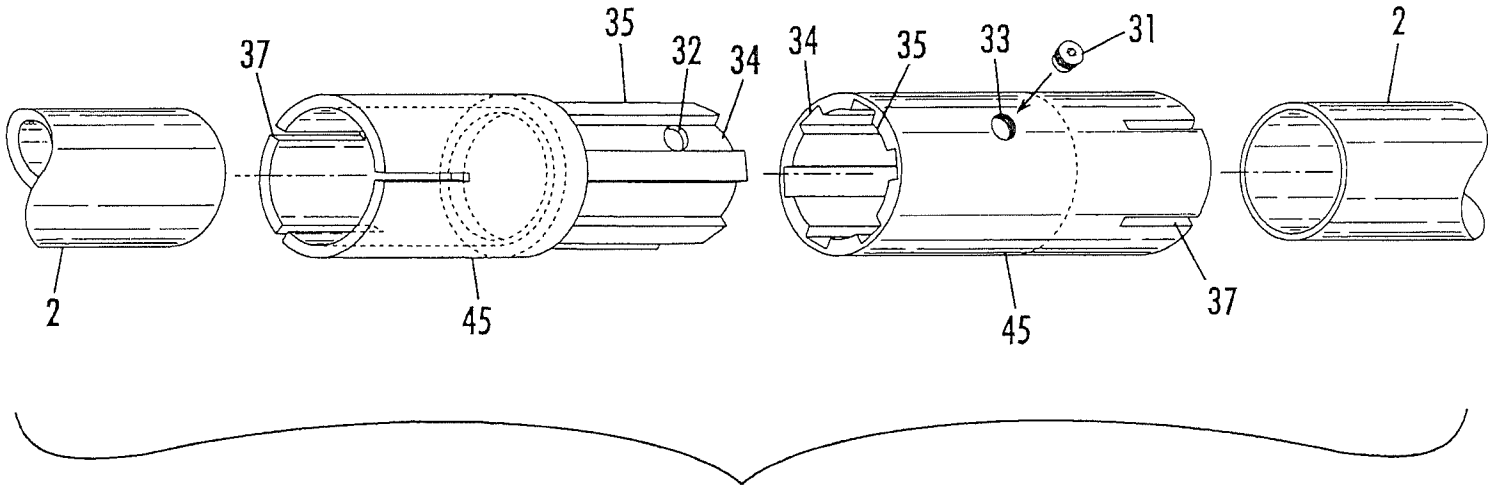
FIGS. 6*a*, 6*b* and 6*c* illustrate yet another type of modified coupling, similar to FIGS. 51, 5*b*, 5*c* and FIGS. 4*a*, 4*b* and 4*c*.
Figure 6B:
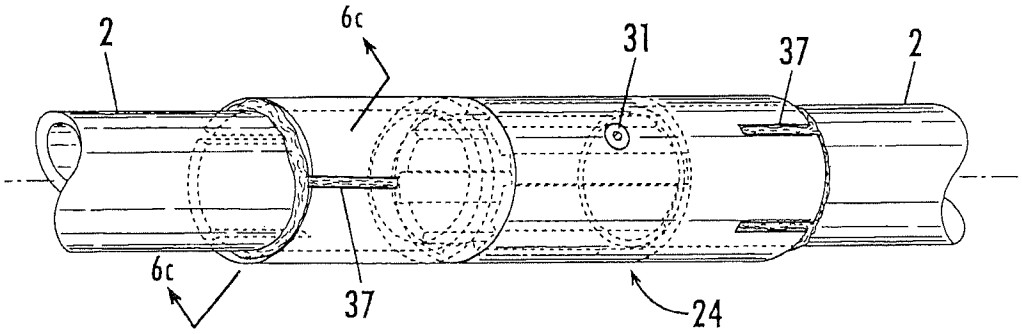
Figure 6C:
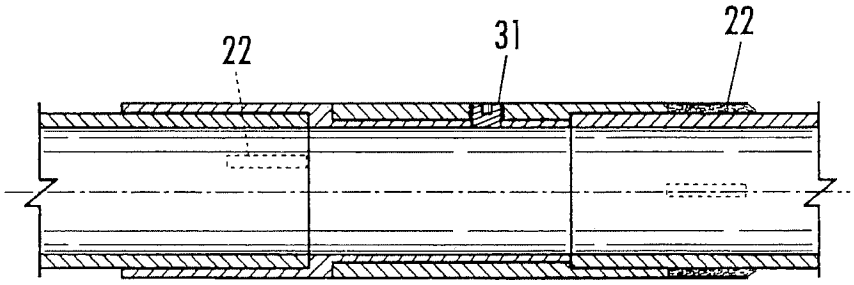

FIGS. 6*a*, 6*b* and 6*c* illustrate another female coupling structure that joins the ends of adjacent aligned penetrator tube and extension tube together, using splined ends of another form. The inter fitting splines 35 lock the ends of the tubes 2 in a non-rotational relationship so that the application of torque to the upper end of the upper tube at ground level is passed through the tubes to the helical plates of the penetrator tube in the ground.

Figure 7A:
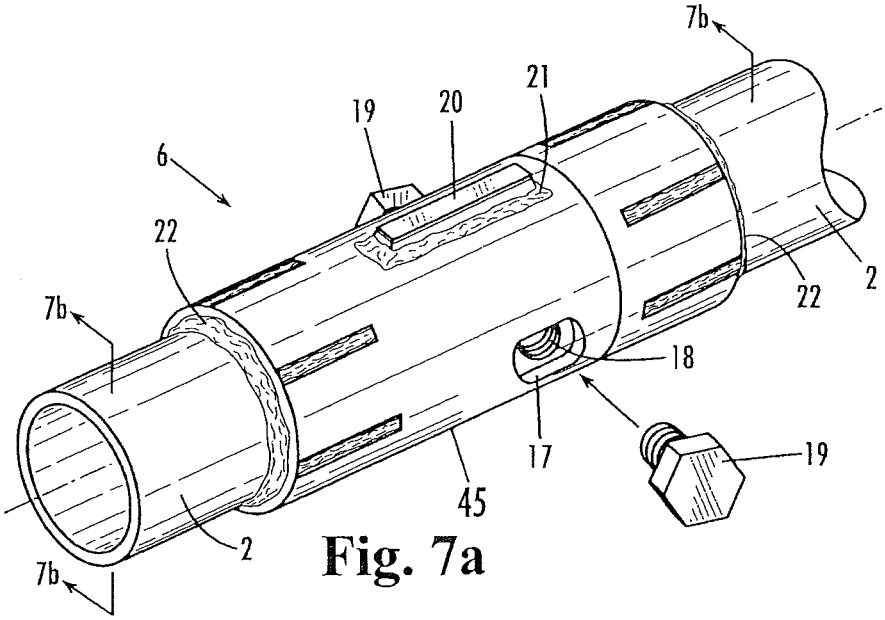
FIGS. 7*a*, 7*b*, and 7*c* illustrate a modified shear key type coupling.
Figure 7B:
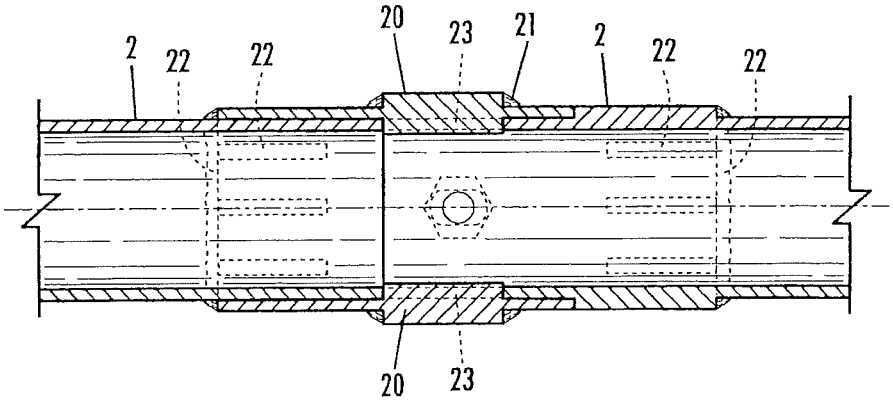
Figure 7C:
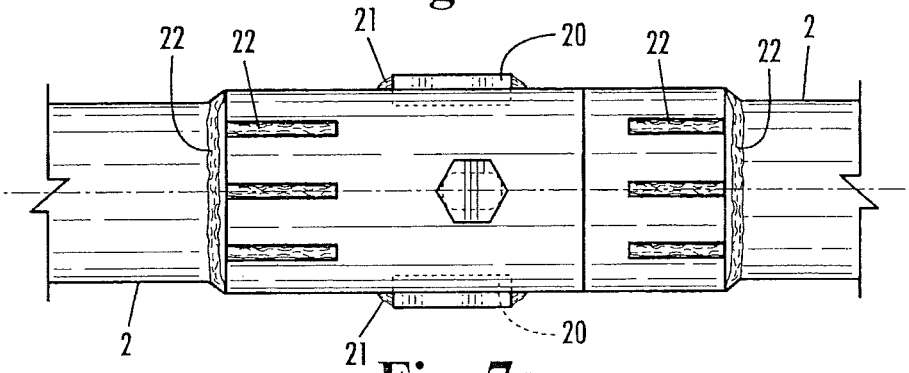

FIGS. 7*a*, 7*b* and 7*c* further illustrate a female coupling structure that joins the ends of adjacent aligned ends of the tubes, with the inner fitting splines locking the ends of the tubes in non-rotational relationship.

Figure 8:
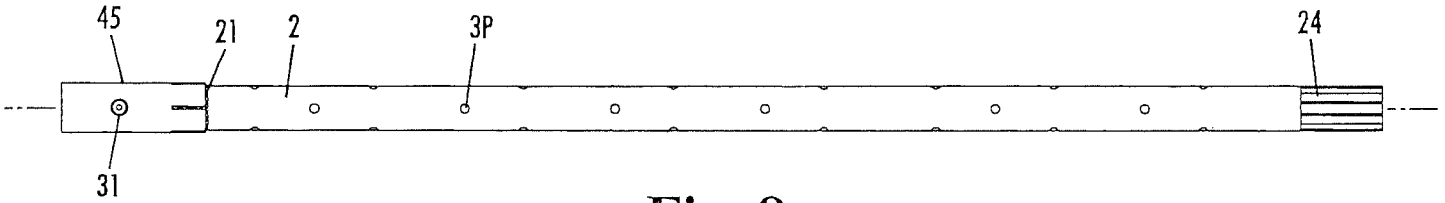
FIGS. 8 and 9 illustrate adjacent external conduits, with FIG. 8 showing the lower conduit with water openings formed therethrough and FIG. 9 showing a similar conduit but without water openings that would be used higher up in the well structure.
Figure 9:
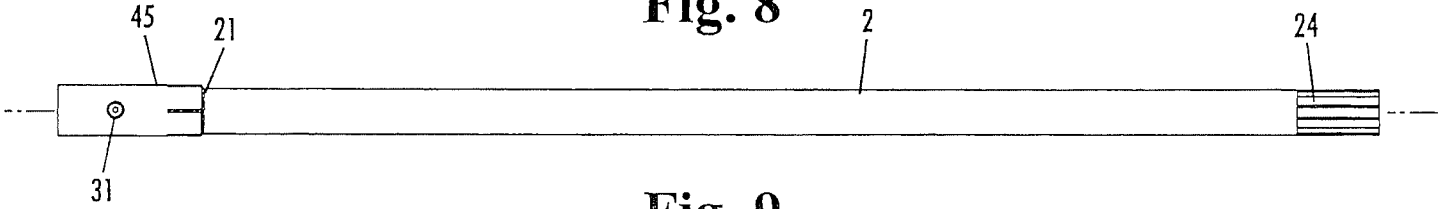

FIGS. 8 and 9 illustrate two forms of the extension tubes, with FIG. 8 showing a tube with ports 3P that admit water from outside the tube, and FIG. 9 showing a tube without ports.

Figure 10A:
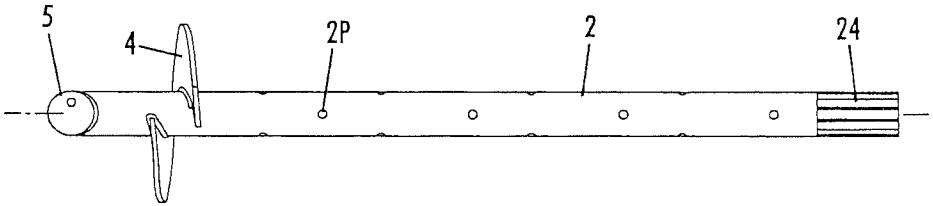
FIGS. 10*a* and 10*b* are side views of segments of the helical displacement well, showing how the helical plates are mounted to the external steel conduit, and a rotated view revealing the end cap and port spacing.
Figure 10B:
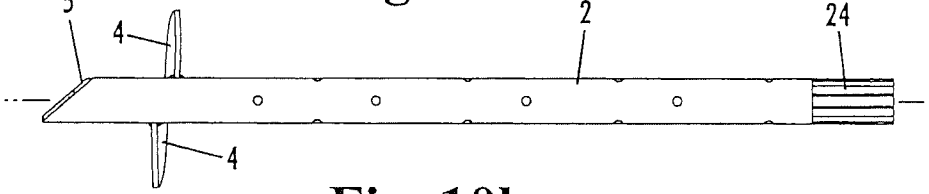
Figure 11A:
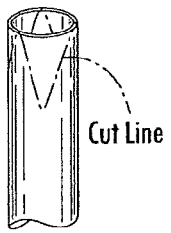
FIGS. 11*a*. 11*b* and 11*c* illustrate a means of manufacturing an integral closed pile point from the lower end of the penetrator tube.
Figure 11B:
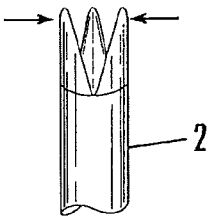
Figure 11C:
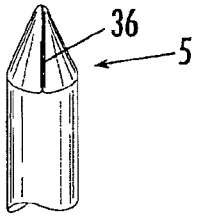
Figure 12:
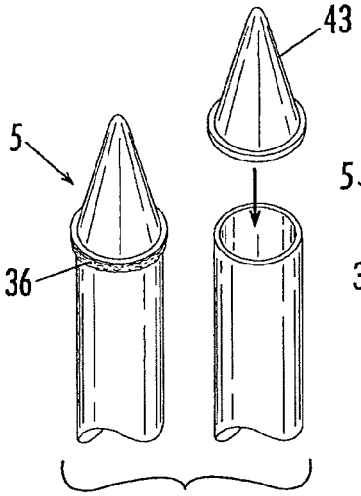
FIGS. 12, 13, and 14 illustrate the different configurations of the seal cap pile point that may be used at the lower end of the penetrator tube.
Figure 13:
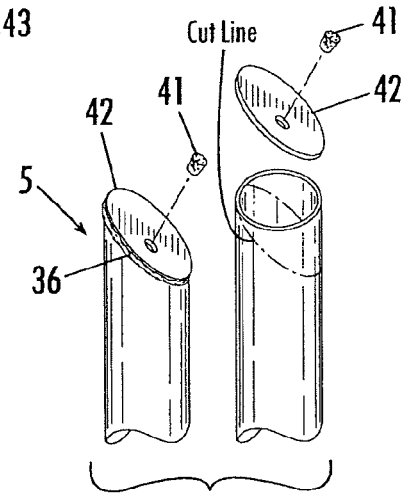
Figure 14:
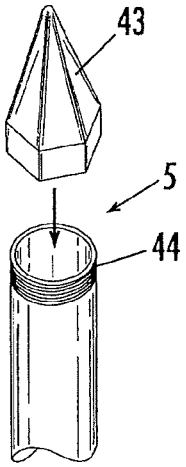

FIGS. 10*a* and 10*b* illustrates penetrator tubes, with FIG. 10*a* showing the seal cap penetration point closing the angled end of the penetrator tube, and FIG. 10*b* showing the same tube turned 90 degrees.

FIGS. 11*a*, 11*b*, 11*c*, 12, 13 and 14 show other forms of the end caps, all of which tend to be aggressive penetrators of the soil when the penetrator tube is rotated and the helical plates force the penetrator tube into the ground.

Figure 15:
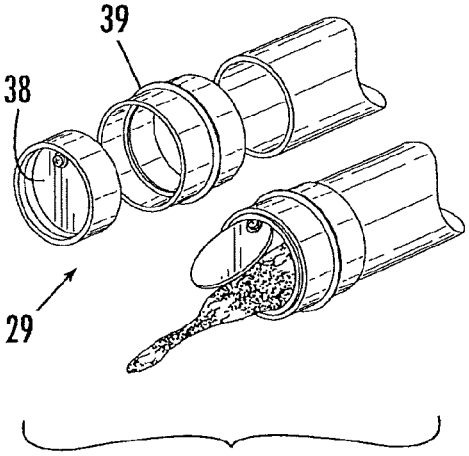
FIG. 15 illustrates a weep hole extension outlet.

FIG. 15 shows the bottom of a penetrator tube and a weep hole extension 29 with a weep hole flap 38 applied to the end opening of the penetrator tube by weep hole sleeve connector 39, showing this attachment both in an expanded view and in a closed view.

Figure 16:
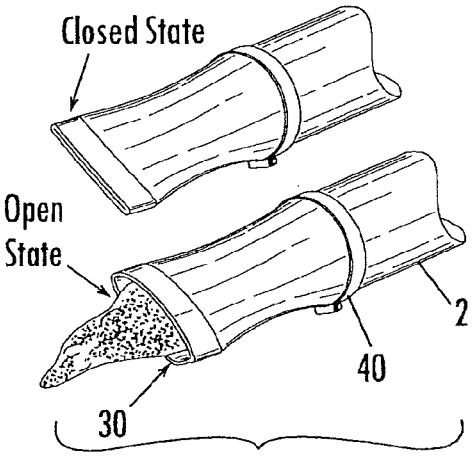
FIG. 16 illustrates a check valve attachment.

FIG. 16 shows the end of a penetrator tube that includes a hydrostatic pressure relief check valve 30 that prevents debris from entering the end of the penetrator tube and that opens in response to the internal fluid pressure that exceeds the pressure about the valve for the purpose of expelling fluid in the lower end of the penetrator tube.

Figure 17:
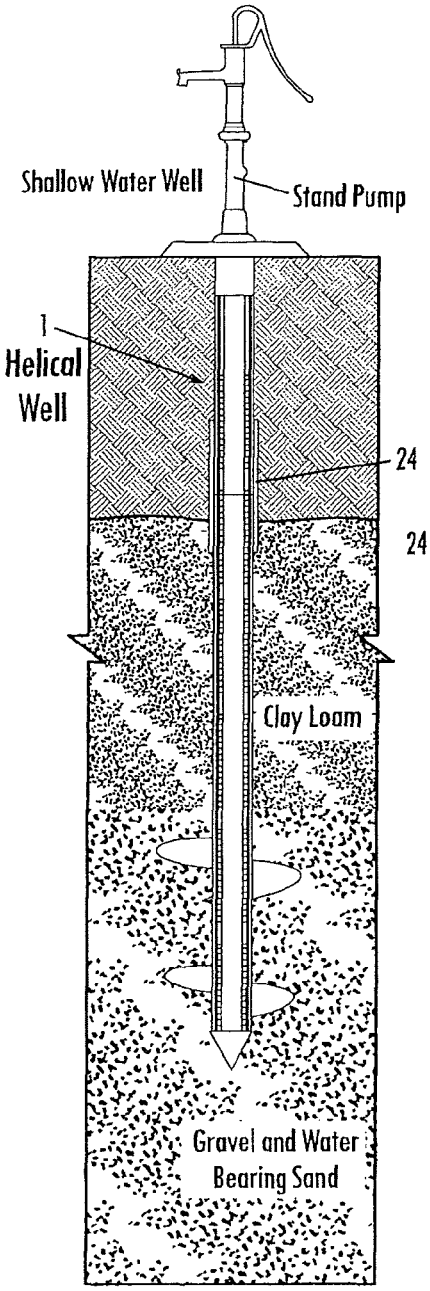
FIG. 17 shows a side elevational view of the helical displacement well as it is installed in the ground.
Figure 20:
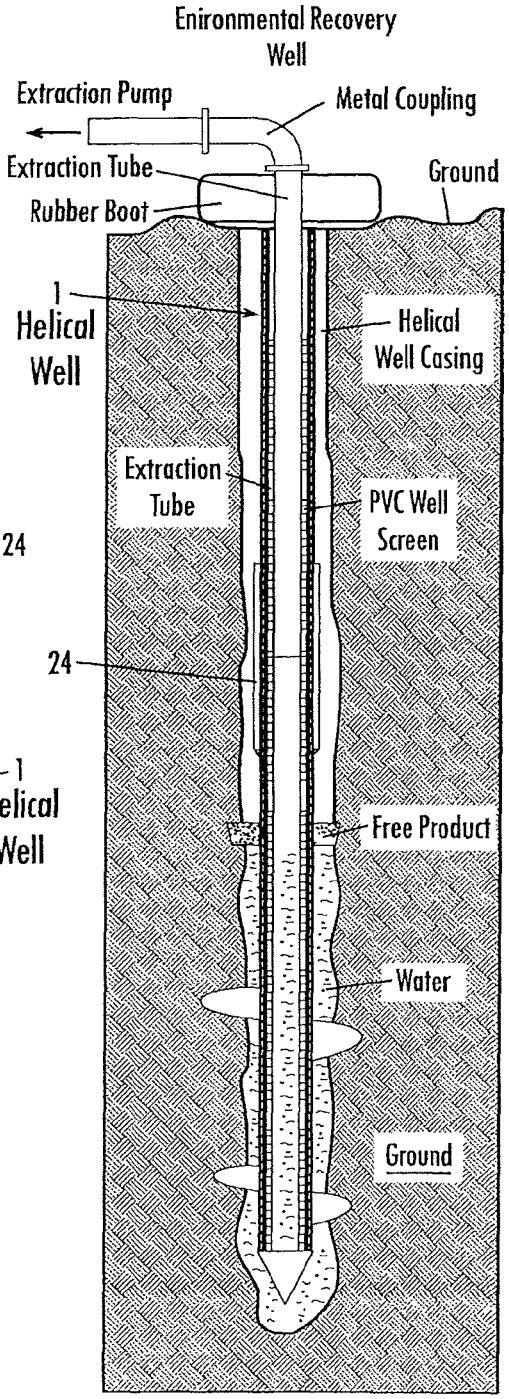
FIG. 20 is a side elevational view of a helical displacement well in an environmental recovery application where contaminants may be treated or extracted from the ground.
Figure 21:
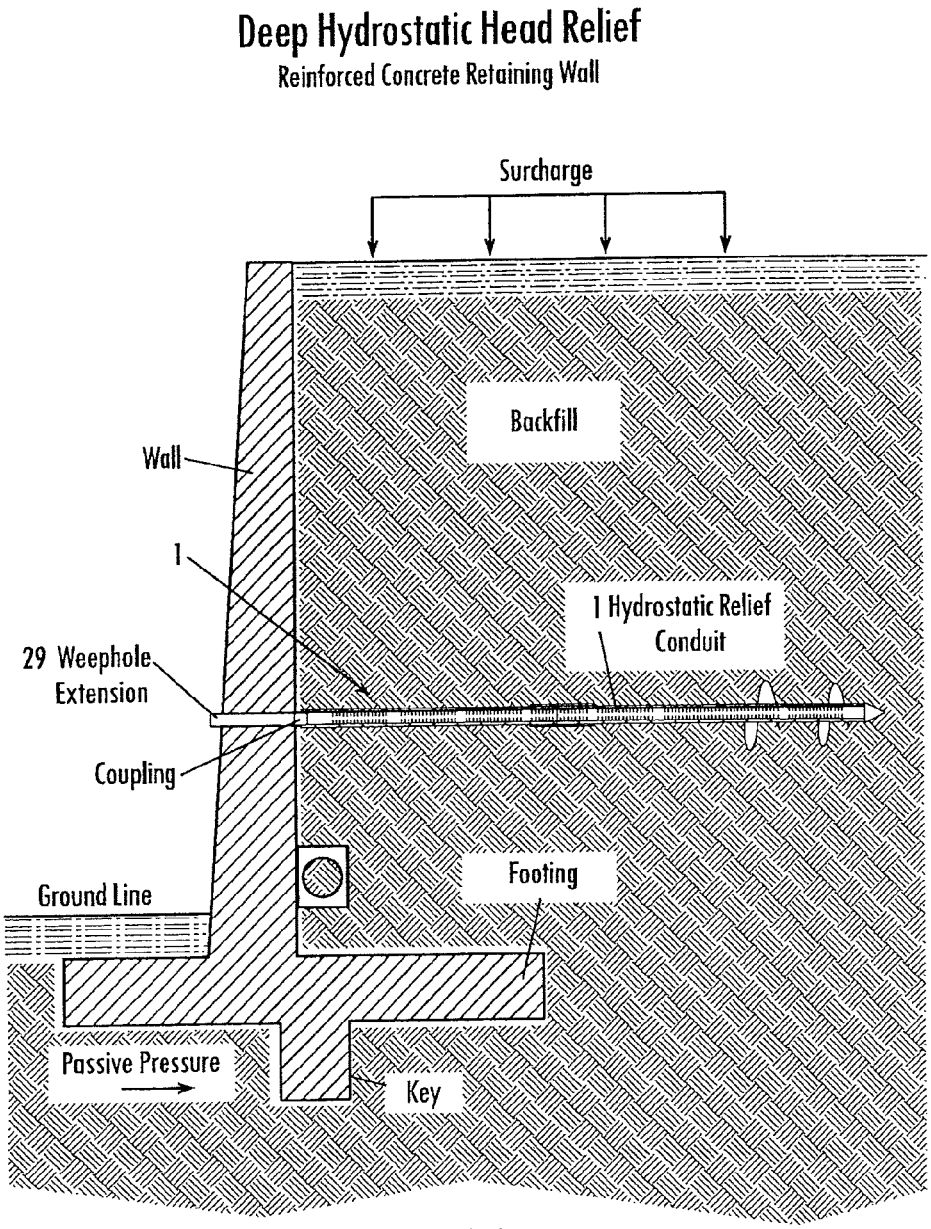
FIG. 21 is a side elevational view, in cross section, showing a hydrostatic head relief well that is installed horizontally through a vertical concrete wall structure for drainage purposes.
Figure 22:
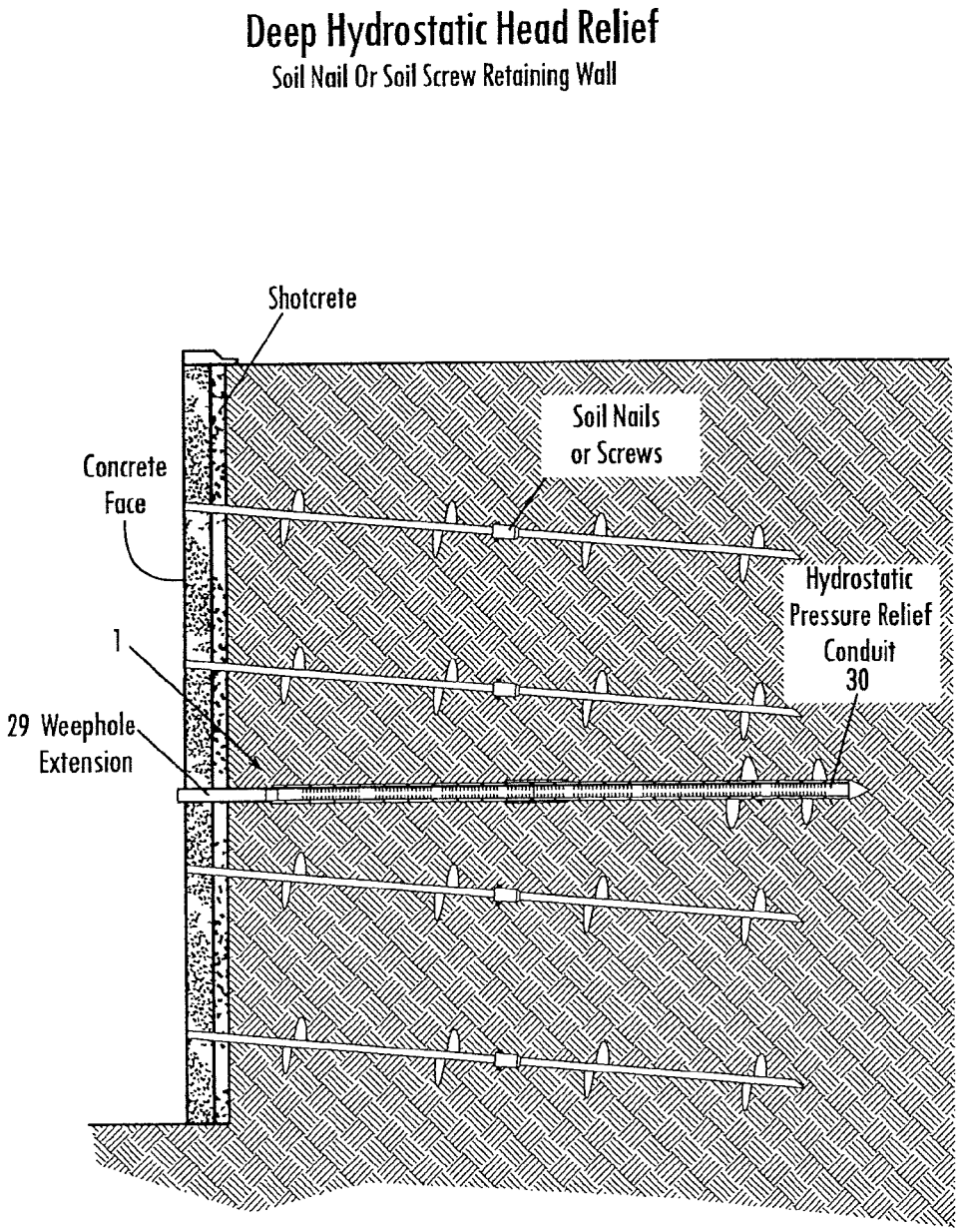
FIG. 22 is another side elevational view, showing the hydrostatic pressure relief well installed through a vertical soil nail wall application.
Figure 23:
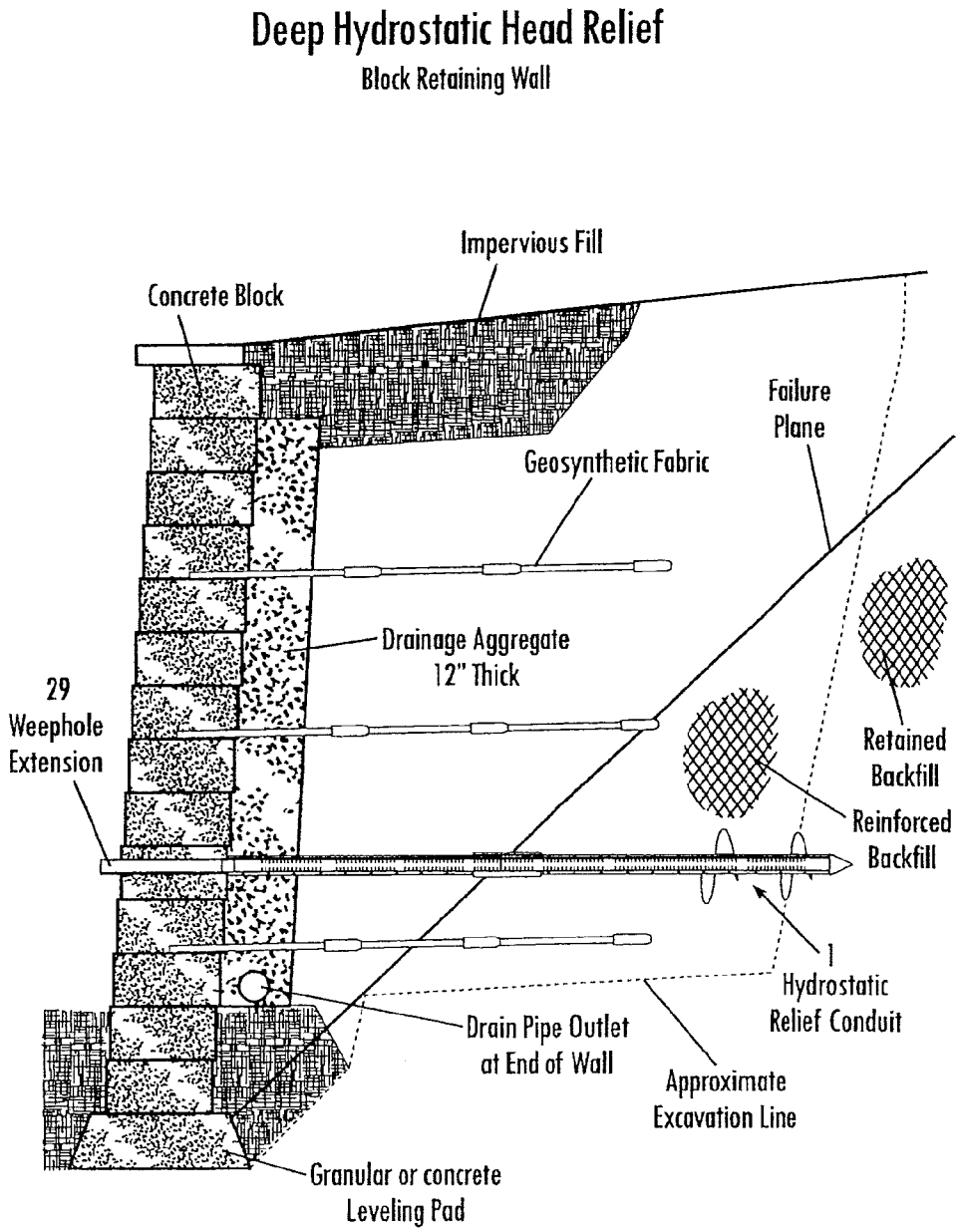
FIG. 23 is a side elevational view, showing the hydrostatic relief well utilized behind a vertical block retaining wall.
Figure 24:
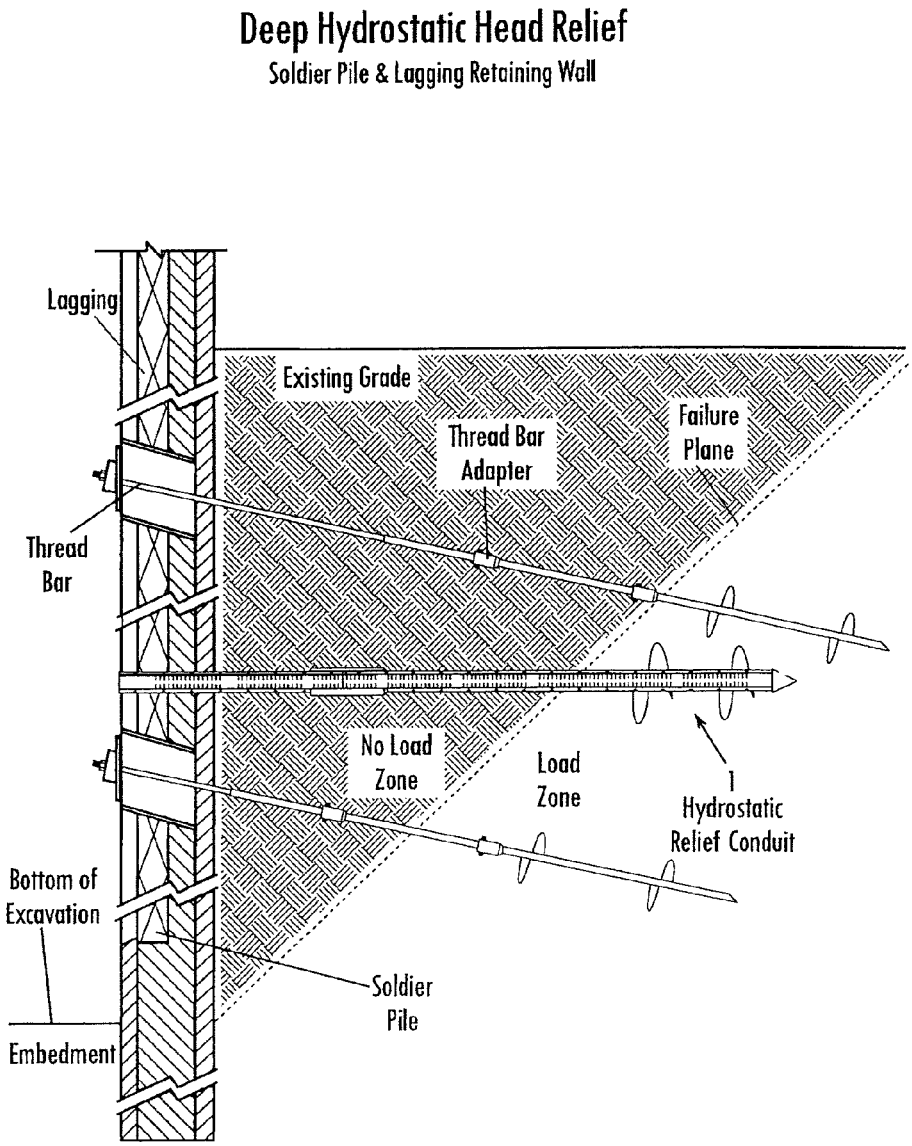
FIG. 24 is a side elevational view, showing the hydrostatic relief well utilized in conjunction with a soldier pile and lagging retaining wall.
Figure 25:
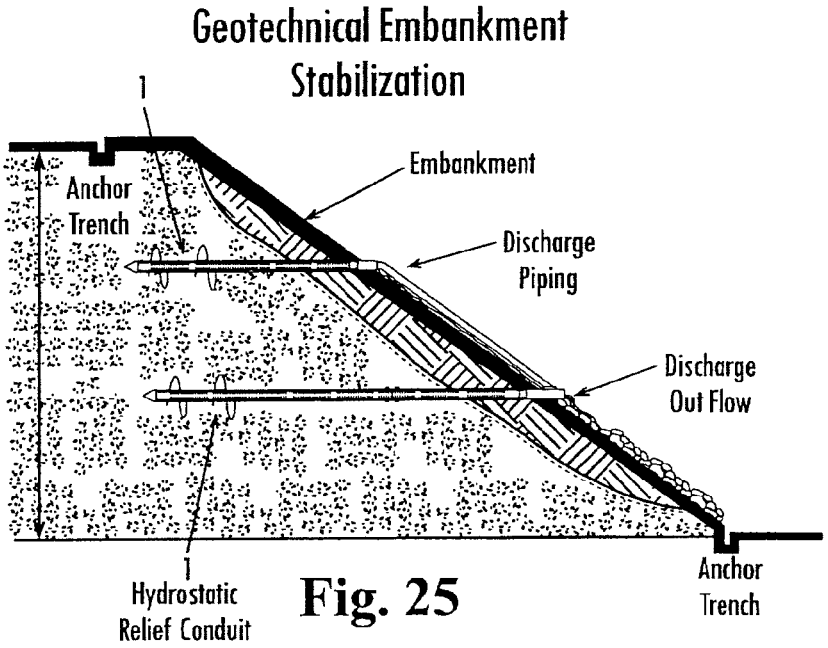
FIG. 25 is a side elevational view, showing the helical displacement wells being used in both hydrostatic groundwater pressure relief as well as a stabilizing internal structural element within the sloped embankment.

As shown in FIGS. 17 and 20, a pump may be connected to a pipe and the pipe extended down into the assembled segments of the helical displacement well. The pump draws the liquid from the well.

Figure 18:
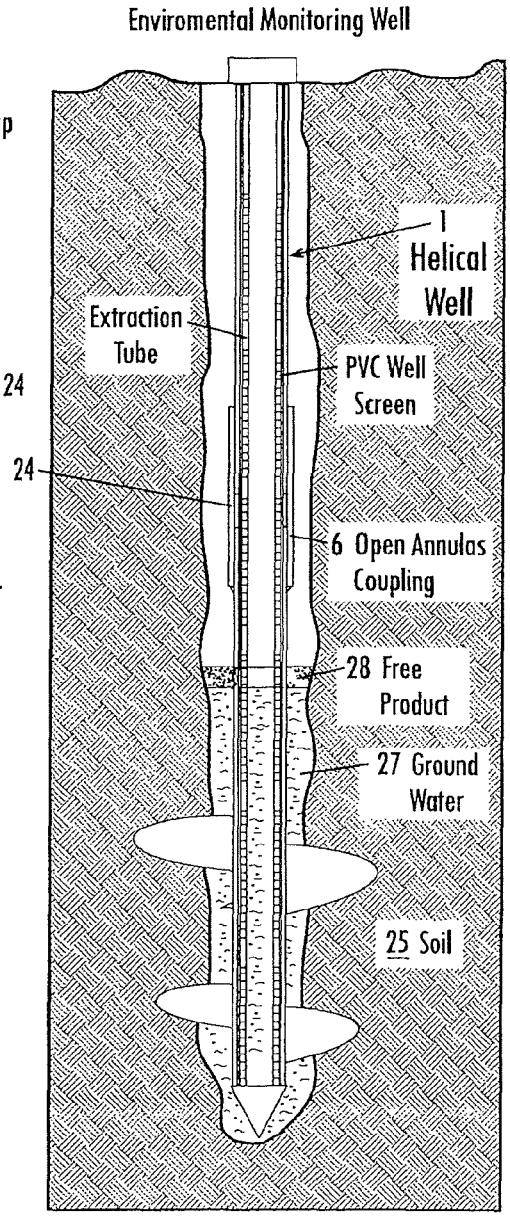
FIG. 18 is a side elevational view of an environmental monitoring well that is used for evaluating groundwater.

As shown in FIG. 18, the well may be closed at its upper end and used as an environmental monitoring well, extend down through free product 28 and into ground water 27.

Figure 19:
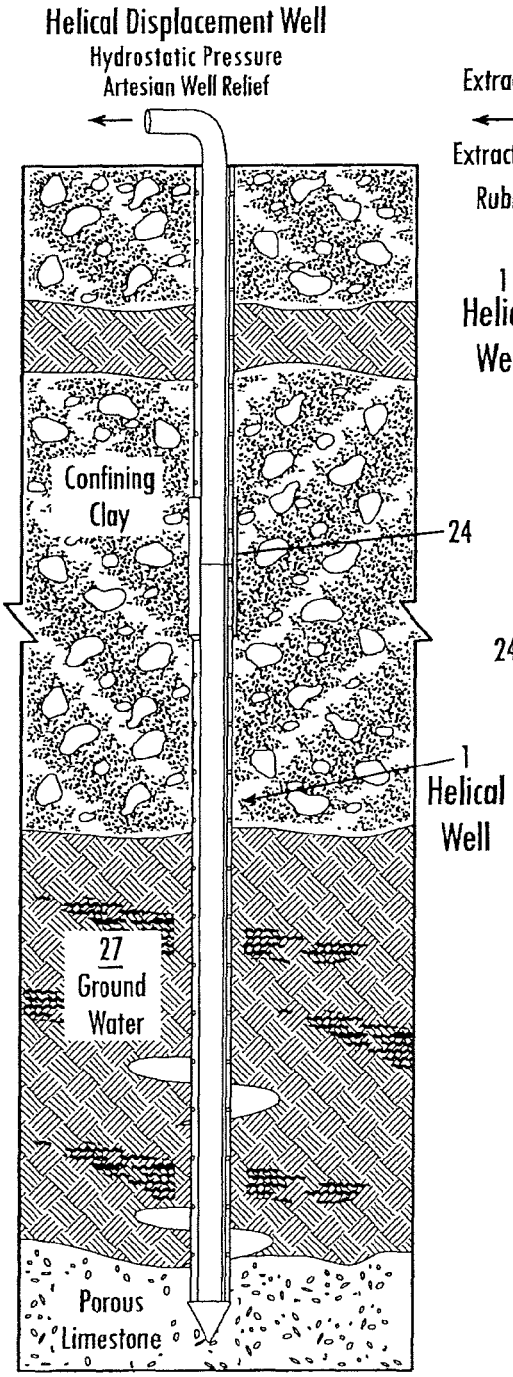
FIG. 19 is a side elevational view of a helical displacement well installed in the ground and in application as an Artesian well.

As shown in FIGS. 19 and 20, a pipe may be inserted down into the helical well that is an Artesian well and the pressure of the natural source of the water moves the water up the pipe.

FIGS. 21-25 illustrate the helical displacement well used horizontally to reach and relieve water trapped behind retaining walls or other vertical structures, while improving the strength of the soil matrix behind the structure or within an embankment.

Figure 26:
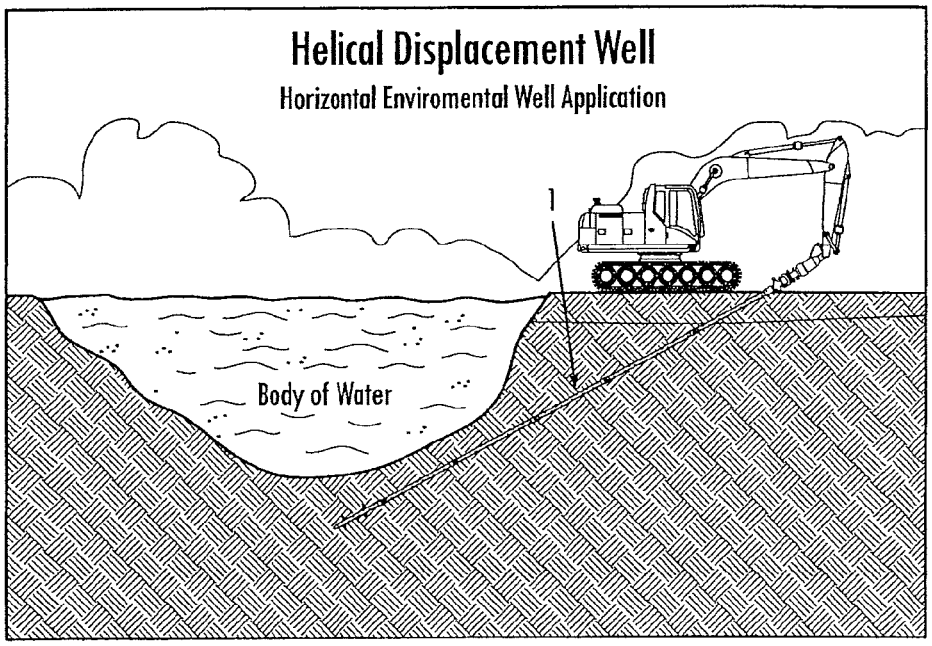
FIG. 26 is a side elevational view of a helical displacement well showing how the well can be installed at an angle beneath a body of water.

FIG. 26 illustrates the helical displacement well used horizontally to reach subterranean water that has strayed from a larger body of water, such as a lake or a river.

Figure 27:
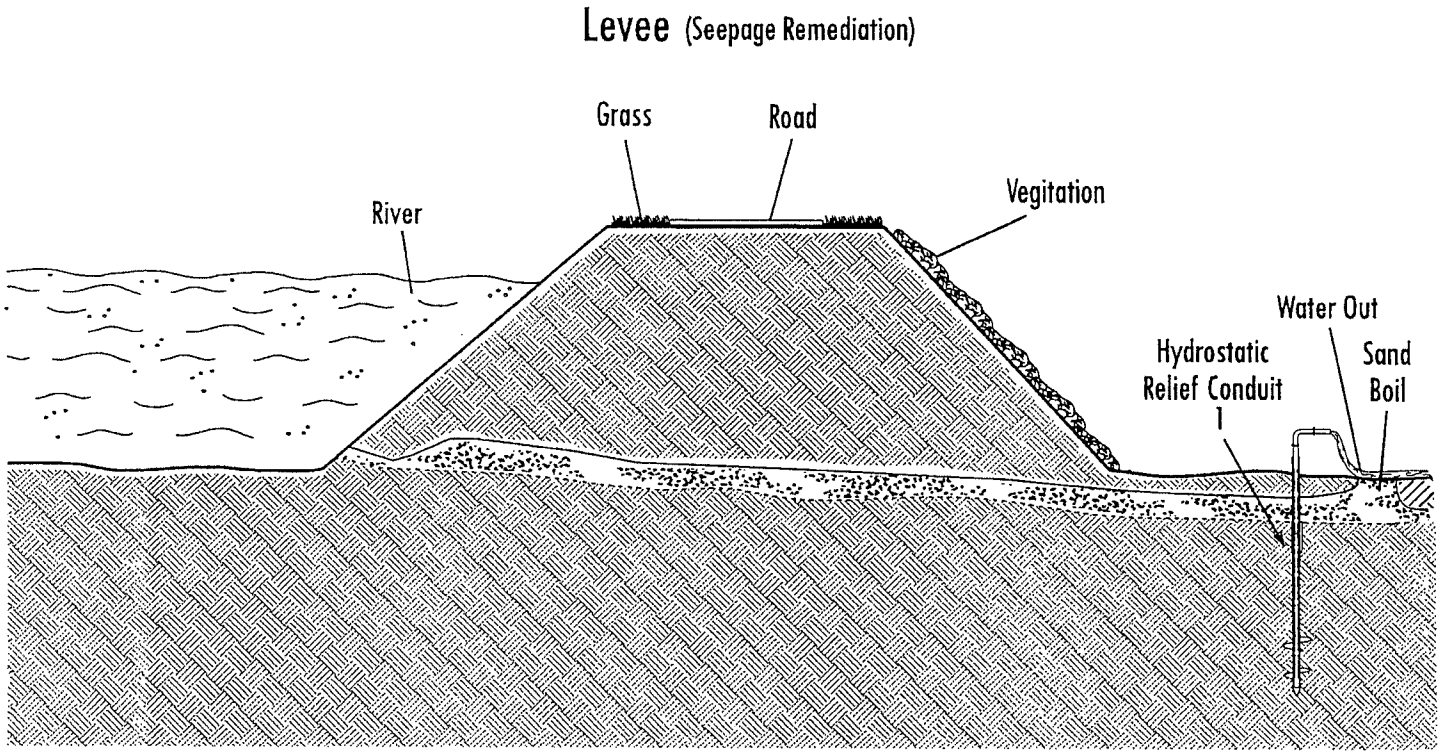
FIG. 27 is a side elevational view of a helical displacement well positioned behind a levee embankment intersecting a line of seepage underneath the levee caused by hydrostatic pressure resulting in an Artesian flow and thusly acting as a hydrostatic pressure relief system.

FIG. 27 illustrates the helical displacement well utilized to relieve hydrostatic groundwater pressure behind a levee due to seepage.

Should the helical displacement well not find water, it can be removed from the earth by rotating it in the opposite direction of installation so that the helix will tend to lift itself out of the earth. This avoids having to abandon parts of assembly in the earth and the time and efforts involved in boring the well shaft when not finding water. The device can be reused as may be desired.

The external surfaces of the casing of the penetrator tube may be coated with an abrasive resistant friction reduction coating of water based silicon epoxy, capable of reducing the amount of surface friction encountered by the surfaces of ground penetrator tube and extension tube during installation into the earth. A suitable coating product as described above is a product known as Slickcoat produced by Foundation Technologies, Inc. of Lawrenceville, Ga., U.S.A.

Figures 28, 29:
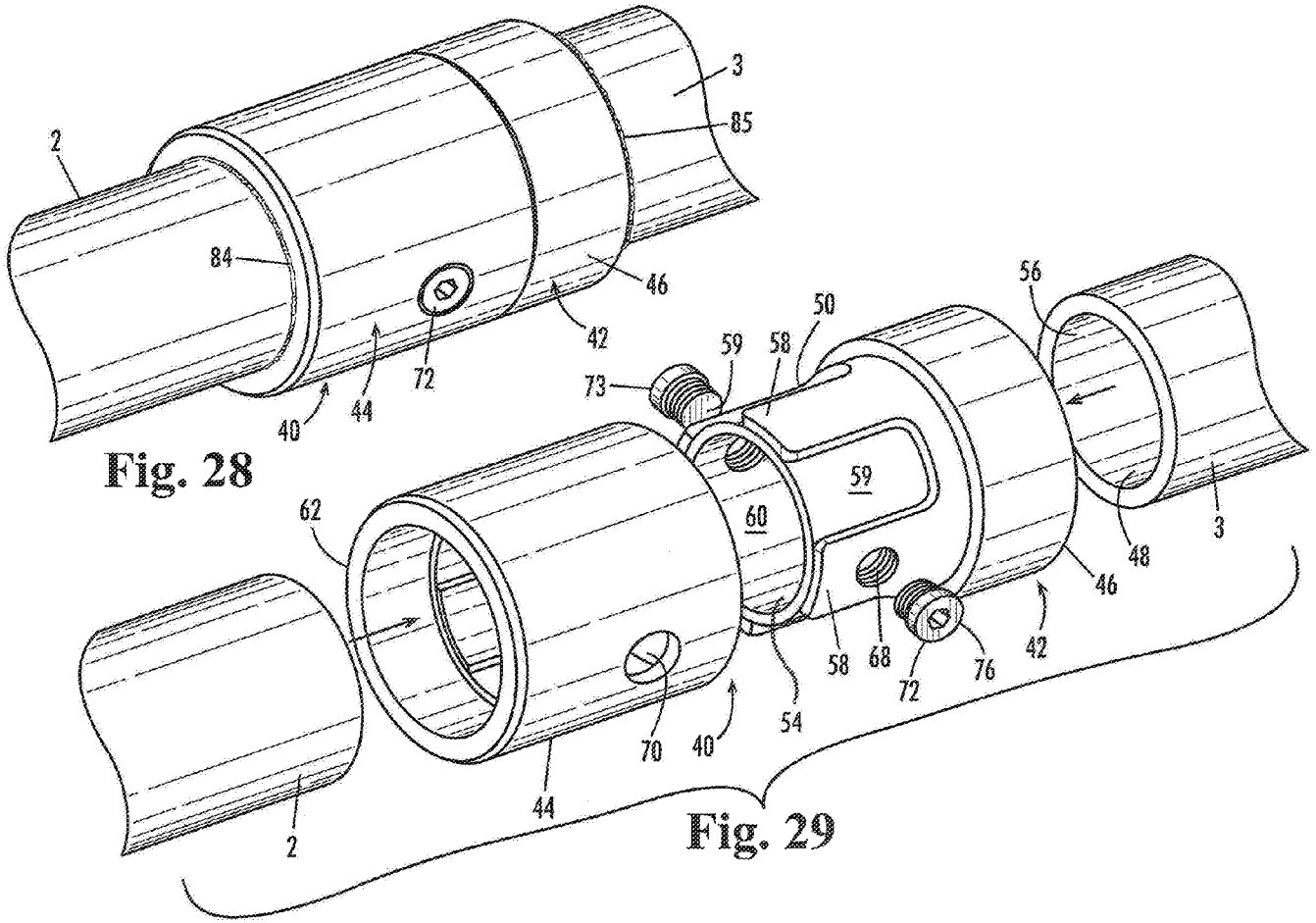
FIG. 28 is an expanded perspective view of an improved coupling with its components connected to one another.
FIG. 29 is a perspective view of the coupling of FIG. 28, showing the components expanded from one another.
Figure 30D:
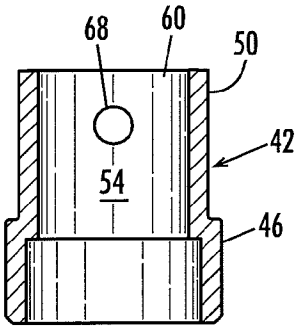
FIGS. 30A, 30B, 30C and 30D, are illustrations of the front, right and back sides, and cross section, of the male component of the coupling, with FIG. 30D showing a cross section of the male component in the configuration of FIG. 30A.
Figure 30C:
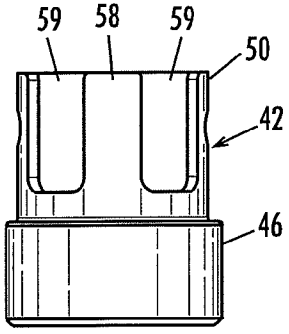
Figure 30B:
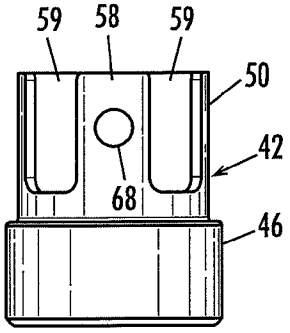
Figure 30A:
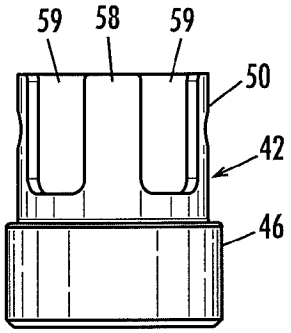
Figure 31D:
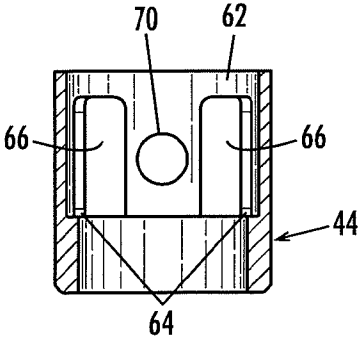
Figure 31C:
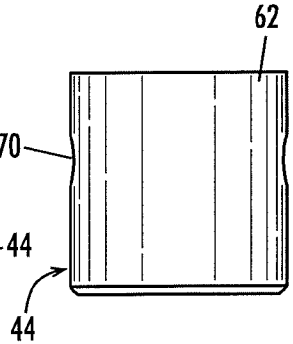
Figure 31B:
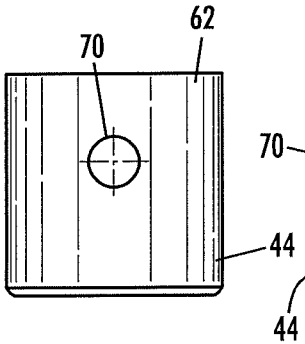
Figure 31A:
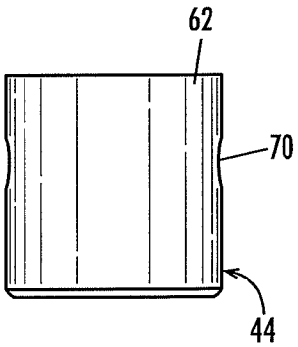

FIGS. 28 and 29 illustrate a coupling that is suitable for use to connect the extension tube 3 to the penetrator tube 2. The coupling connects the extension tube in alignment with the penetrator tube and includes a male connector 42 and a female connector 44 that fit telescopically together. The male connector includes a cylindrical collar 46 that defines cylindrical passage 54 that extends there through that is sized and shaped to receive an end of the penetrator tube or the extension tube. The male connector further includes a hollow plug 50 that is to be inserted into the female connector 44. The plug is of smaller breadth than the collar 46 and extends axially away from the collar and is of smaller breadth than the female connector 44. The plug 50 includes a plug internal passage 54 having a breadth sized and shaped to extend coextensively with the internal passage 56 of the extension tube 3.

As shown best in FIGS. 30A-30D, the male connector includes alignment ribs 58 extending longitudinally from the cylindrical collar 46 and defining there between alignment slots 59 that extend longitudinally away from the cylindrical collar 46. The plug also defines an internal passage 60 that extends axially there through, the plug internal passage having a breadth sized and shaped to extend coextensively with the internal passage of the penetrator tube or the extension tube, and including at least one external alignment rib 58 that extends longitudinally there along.

The female connector 44 as shown in FIGS. 31A, 31B, 31C and 31D includes at one end an internal collar 62, and locking strips 64 that define between them locking slots 66. The locking slots 66 are sized and shaped to receive the alignment ribs 58 of the male connector 42 so that there is a predetermined alignment created between the male connector 42 and the female connector 44 when they are assembled together as shown in FIG. 28.

Tension bolt openings 68 are formed in the alignment ribs 58 of the male connector 42, and the tension bolt openings may be diametrically opposed. Complementary tension bolt openings 70 are formed in the female connector 44 that may be diametrically opposed and are to be aligned with the tension bolt openings 68 of the male connector 42 when the male and female connectors are assembled as shown in FIG. 28.

As shown in FIGS. 28 and 29, recessed tension bolts 72 and 73 are to be inserted in the aligned tension bolt openings 68 and 70 when the male connector 42 is inserted in the female connector 44. The tension bolts 72 and 73 each have an externally threaded stem 75 that is sized to engage the internal threads of the screw openings 68 and hold the bolts in place and an enlarged circular cap 76 that is sized and shaped to register with the opening 70 of the female connector.

When the male connector 42 is fully inserted into the female connector 44, as shown in FIG. 28, the internally threaded tension bolt openings 68 of the male connector will be aligned with the unthreaded complementary tension bolt openings 70 of the female connector 44, and the tension bolts 72 and 73 may be inserted into the aligned openings and their screw threads screwed into the threads of the screw openings 68 of the male connector. The enlarged cap 76 of the tension bolts 72 are sized to fit the complementary opening of the female connector so that the tension bolts are positioned approximately in the same plane of the exterior surface of the female connector 44. The stress applied to the tension bolts by the relative rotary movements of the male connector with respect to the female connector are minimized by the close fitting shapes of the alignment ribs 58 of the male connector 42 with the locking slots 66 of the female connector 44.

The male and female connectors 42 and 44 may be rigidly connected to the ends of the adjacent penetrator tube 2 and extension tube 3, respectively, as shown by the weld seams 84 and 85 in FIG. 28. Usually this is the only connection used for connecting the male and female connectors to the adjacent penetrator tube and adjacent extension tube.

Typically, the male and female connectors will be rigidly mounted to the ends of the adjacent penetrator tube and extension tube prior to assembling the helical displacement well assembly at the site. When the penetrator tube has been partially moved toward its desired position in the earth, with the penetrator tube still extending above the earth, the extension tube, with its connector, is connected to the penetrator tube by aligning the alignment ribs 58 of the male connector with the locking slots 66 of the female connector and moving the connectors telescopically together to the positions illustrated in FIG. 28, and moving the connectors telescopically together until the tension bolt openings 68 of the male connector are aligned with the tension bolt openings 70 of the female connector. The tension bolts 72 and 73 may then screwed into the aligned tension bolt openings, thereby mounting the male and female connectors together. The aligned and connected tubes can then be inserted farther into the earth by rotating the protruding extension tube that, in turn, rotates the penetrator tube.

It will be obvious to those skilled in the art that variations and modifications of the disclosed embodiment can be made without departing from the spirit and scope of the invention as set forth in the following claims.

The invention claimed is:

1. A helical displacement well assembly for expediently penetrating earth, including:

a penetrator tube for rotary insertion in the earth;

an extension tube mounted coaxially adjacent said penetrator tube, the penetrator tube and the extension tube each including an internal passage extending axially there through;

a coupling positioned between and connecting the extension tube in alignment to the penetrator tube, the coupling comprising a male connector and a female connector shaped to fit together;

the male connector including a cylindrical collar defining an axial opening extending there through sized and shaped to receive an end of one of the penetrator tube or the extension tube, and a plug of smaller breadth than the cylindrical collar extending axially away from the cylindrical collar, the plug including a plug internal passage extending axially there through, the plug internal passage having a breadth sized and shaped to extend coextensively with the internal passage of the penetrator tube or the extension tube and including at least one external alignment rib extending longitudinally there along, the female connector including a cylindrical collar defining an axial opening extending there through sized and shaped to receive an end of one of the penetrator tube or extension tube and with an interior sized and shaped to fit about the plug of the male connector and including a locking strip sized and shaped to mate with the external alignment rib of the male connector, the female connector defining at least one unthreaded tension bolt opening extending laterally there through, and an external rib of the male connector defining a threaded tension bolt opening positioned to align with the unthreaded tension bolt opening of the female connector when the male connector is inserted into the female connector; and a tension bolt including a threaded stem sized to engage the threaded tension bolt opening and a cap of larger breadth than the threaded stem and sized to fit within the unthreaded tension bolt opening of the female connector for connecting the female connector about the male connector.

2. The helical displacement well assembly of claim 1, wherein the threaded bolt opening of the male connector is formed in the at least one external alignment rib.

3. The helical displacement well assembly of claim 1, wherein the cap of the tension bolt is unthreaded.

4. The helical displacement well assembly of claim 1, wherein the cap of the tension bolt is coextensive with the cylindrical collar of the female connector.

5. The helical displacement well assembly of claim 1, wherein the cylindrical collar of the male connector is welded to one of the penetrator tube or extension tube.

6. The helical displacement well assembly of claim 1, wherein the cylindrical collar of the female connector is welded to one of the penetrator tube or extension tube.

7. The helical displacement well assembly of claim 1, further comprising a helical plate mounted to an exterior surface of the penetrator tube, wherein the helical plate creates thrust in to the earth to radially compact adjacent soil when the penetrator tube is rotated to insert the penetrator tube in to the earth.

8. The helical displacement well assembly of claim 7, wherein the helical plate does not extend to an outer surface of the cylindrical collar of the male connector and an outer surface of the cylindrical collar of the female connector.

9. A helical displacement well assembly for expediently penetrating earth, including:

a penetrator tube for rotary insertion in the earth;

an extension tube mounted coaxially adjacent said penetrator tube, the penetrator tube and the extension tube each including an internal passage extending axially there through;

a coupling positioned between and connecting the extension tube in alignment with the penetrator tube;

the coupling comprising a male connector on one of the extension tube and the penetrator tube and a female connector on the other of the extension tube and penetrator tube, the coupling including interfitting ribs that avoid rotation of the male and female connectors with respect to each other, the male connector defining a threaded bolt opening and the female connector defining a bolt opening that aligns with the threaded bolt opening; and a tension bolt including a threaded stem sized to engage the threaded bolt opening and a cap sized to fit within the bolt opening of the female connector for connecting the female connector about the male connector.

10. The helical displacement well assembly of claim 9, wherein the cap of the tension bolt is coextensive with a cylindrical collar of the female connector.

* * * * *